US012637318B2

(12) United States Patent
Yamada et al.

(10) Patent No.: US 12,637,318 B2
(45) Date of Patent: May 26, 2026

(54) SHEET PROCESSING APPARATUS, IMAGE FORMING APPARATUS, AND IMAGE FORMING SYSTEM

(71) Applicants: Jun Yamada, Kanagawa (JP); Yuusuke Shibasaki, Tokyo (JP); Atsushi Shinoda, Kanagawa (JP); Shuuto Tohkaishi, Kanagawa (JP); Satoshi Hirata, Kanagawa (JP); Shingo Yoshizawa, Kanagawa (JP); Suzuka Fujita, Kanagawa (JP); Naofumi Yoshida, Kanagawa (JP); Ryota Takayama, Kanagawa (JP); Takahiro Watanabe, Kanagawa (JP); Takuya Morinaga, Tokyo (JP); Yuji Suzuki, Kanagawa (JP); Wataru Nozaki, Kanagawa (JP); Kanako Fujisaki, Kanagawa (JP); Yusuke Hirono, Kanagawa (JP)

(72) Inventors: Jun Yamada, Kanagawa (JP); Yuusuke Shibasaki, Tokyo (JP); Atsushi Shinoda, Kanagawa (JP); Shuuto Tohkaishi, Kanagawa (JP); Satoshi Hirata, Kanagawa (JP); Shingo Yoshizawa, Kanagawa (JP); Suzuka Fujita, Kanagawa (JP); Naofumi Yoshida, Kanagawa (JP); Ryota Takayama, Kanagawa (JP); Takahiro Watanabe, Kanagawa (JP); Takuya Morinaga, Tokyo (JP); Yuji Suzuki, Kanagawa (JP); Wataru Nozaki, Kanagawa (JP); Kanako Fujisaki, Kanagawa (JP); Yusuke Hirono, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 241 days.

(21) Appl. No.: 18/733,909

(22) Filed: Jun. 5, 2024

(65) Prior Publication Data

US 2024/0400337 A1 Dec. 5, 2024

(30) Foreign Application Priority Data

Jun. 5, 2023 (JP) ..... 2023-092551
Feb. 29, 2024 (JP) ..... 2024-030270

(51) Int. Cl.
*B65H 37/04* (2006.01)

(52) U.S. Cl.
CPC ..... *B65H 37/04* (2013.01); *B65H 2301/433* (2013.01); *B65H 2301/51616* (2013.01); *B65H 2301/5162* (2013.01); *B65H 2801/27* (2013.01)

(58) Field of Classification Search
CPC ..... B65H 37/04; B65H 2301/5161; B65H 2301/51611; B65H 2301/51616;
(Continued)

(56) References Cited

U.S. PATENT DOCUMENTS 6,926,791 B2 * 8/2005 Boss ..... B42C 9/0093 412/8
8,960,660 B2 * 2/2015 Furuhashi ..... B31F 1/0035 271/226

(Continued)

FOREIGN PATENT DOCUMENTS

JP 2013-086880 A 5/2013
JP 2015-101009 A 6/2015

(Continued)

*Primary Examiner* — Michael Mccullough
(74) *Attorney, Agent, or Firm* — XSENSUS LLP

(57) ABSTRACT

A sheet processing apparatus includes: an ejection tray; an internal tray; a first conveyor to convey a sheet medium in a first direction in which the sheet medium is ejected to the ejection tray; a second conveyor to come into contact with (Continued)

and separate from sheet media stacked on the internal tray to convey the sheet media in a second direction different from the first direction; a crimp binder downstream from the internal tray in the second direction to execute crimp binding on the sheet media stacked on the internal tray; and control circuitry. When a subsequent sheet medium, which is subsequent to a preceding sheet medium of the sheet media stacked on the internal tray, is conveyed in the first direction while contacting the preceding sheet medium, the control circuitry causes the crimp binder to press a downstream end of the preceding sheet medium in the second direction.

13 Claims, 24 Drawing Sheets

(58) Field of Classification Search
CPC ..... B65H 2301/5162; G03G 15/6544; G03G 15/6541; G03G 2215/00848; G03G 2215/00822; G03G 2215/00852; B31F 5/02
See application file for complete search history.

(56) References Cited

U.S. PATENT DOCUMENTS

| | | | | |
|---|---|---|---|---|
| 9,415,560 | B2 * | 8/2016 | Morinaga | B31F 5/02 |
| 9,725,274 | B2 * | 8/2017 | Taguchi | B65H 37/02 |
| 9,764,582 | B2 * | 9/2017 | Taguchi | B65H 45/18 |
| 12,434,501 | B2 * | 10/2025 | Nakahara | B42B 5/00 |
| 12,503,331 | B2 * | 12/2025 | Seto | B65H 37/04 |
| 2012/0083400 | A1 | 4/2012 | Shibasaki et al. | |
| 2012/0153556 | A1 | 6/2012 | Sugiyama et al. | |
| 2012/0282004 | A1 | 11/2012 | Furuhashi et al. | |
| 2014/0227064 | A1 * | 8/2014 | Matsue | B42C 13/003 412/37 |
| 2015/0360899 | A1 | 12/2015 | Takahashi et al. | |
| 2016/0340144 | A1 | 11/2016 | Sakano et al. | |
| 2016/0360053 | A1 | 12/2016 | Suzuki et al. | |
| 2020/0140222 | A1 | 5/2020 | Takahashi et al. | |

FOREIGN PATENT DOCUMENTS

| | | | |
|---|---|---|---|
| JP | 2016-210555 | A | 12/2016 |
| JP | 2018-199244 | A | 12/2018 |

* cited by examiner

SHEET PROCESSING APPARATUS, IMAGE FORMING APPARATUS, AND IMAGE FORMING SYSTEM

CROSS-REFERENCE TO RELATED APPLICATIONS

This patent application is based on and claims priority pursuant to 35 U.S.C. § 119 (a) to Japanese Patent Application Nos. 2023-092551, filed on Jun. 5, 2023, and 2024-030270, filed on Feb. 29, 2024, in the Japan Patent Office, the entire disclosure of each of which is hereby incorporated by reference herein.

BACKGROUND

Technical Field

The present disclosure relates to a sheet processing apparatus, an image forming apparatus, and an image forming system.

Related Art

A sheet processing apparatus that performs predetermined processing on a sheet medium on which an image is formed by an image forming apparatus is known. An image forming system in which a sheet processing apparatus and an image forming apparatus are coupled together is also known.

A plurality of processes is known for a predetermined sheet process (which corresponds to a post-process step in the image forming process and is therefore sometimes referred to as the "post-process") executed in the sheet processing apparatus. For example, a sheet alignment process in which a plurality of media (sheets) is stacked with the ends aligned, a binding process for binding the ends of the aligned sheet bundle, a folding process for folding a sheet into a predetermined shape (for example, a Z fold, an outer three fold, a two fold, or the like), and so forth are known.

SUMMARY

The present disclosure provides a sheet processing apparatus that includes: an ejection tray to stack a plurality of sheet media; an internal tray to stack the sheet media at a position different from the ejection tray; a first conveyor to convey a sheet medium in a first direction in which the sheet medium is ejected to the ejection tray; a second conveyor to come into contact with and separate from the sheet media stacked on the internal tray to convey the sheet media in a second direction different from the first direction; a crimp binder disposed downstream from the internal tray in the second direction to execute crimp binding on the sheet media stacked on the internal tray; and control circuitry configured to control operations of the first conveyor, the second conveyor, and the crimp binder. When a subsequent sheet medium, which is subsequent to a preceding sheet medium of the sheet media stacked on the internal tray, is conveyed in the first direction while contacting the preceding sheet medium, the control circuitry causes the crimp binder to press a downstream end of the preceding sheet medium in the second direction.

The present disclosure also provides a sheet processing apparatus that includes: an ejection tray to stack a plurality of sheet media; an internal tray to stack the sheet media in a different position from the ejection tray; a first conveyor to convey a sheet medium in a first direction in which the sheet medium is ejected to the ejection tray; a second conveyor to come into contact with and separate from the sheet media stacked on the internal tray to convey the sheet media in a second direction different from the first direction; a liquid applier disposed downstream from the internal tray in the second direction to perform liquid application to the sheet media stacked on the internal tray; a crimp binder disposed downstream from the internal tray in the second direction to execute crimp binding on the sheet media stacked on the internal tray; and control circuitry configured to control operations of the first conveyor, the second conveyor, the liquid applier, and the crimp binder. When a subsequent sheet medium, which is subsequent to a preceding sheet medium of the sheet media stacked on the internal tray, is conveyed in the first direction while contacting the preceding sheet medium, the control circuitry causes the liquid applier or the crimp binder to press a downstream end of the preceding sheet medium in the second direction.

The present disclosure also provides an image forming apparatus that includes: a housing; an image former housed in the housing to form an image on a sheet medium; and the sheet processing apparatus described above to execute crimp binding of the sheet medium on which the image has been formed by the image former. The sheet processing apparatus is detachably supported by the housing.

The present disclosure also provides an image forming system that includes: an image forming apparatus to form an image on a sheet medium; and the sheet processing apparatus described above coupled to the image forming apparatus.

BRIEF DESCRIPTION OF THE DRAWINGS

A more complete appreciation of embodiments of the present disclosure and many of the attendant advantages and features thereof can be readily obtained and understood from the following detailed description with reference to the accompanying drawings, wherein.

Figure 1:
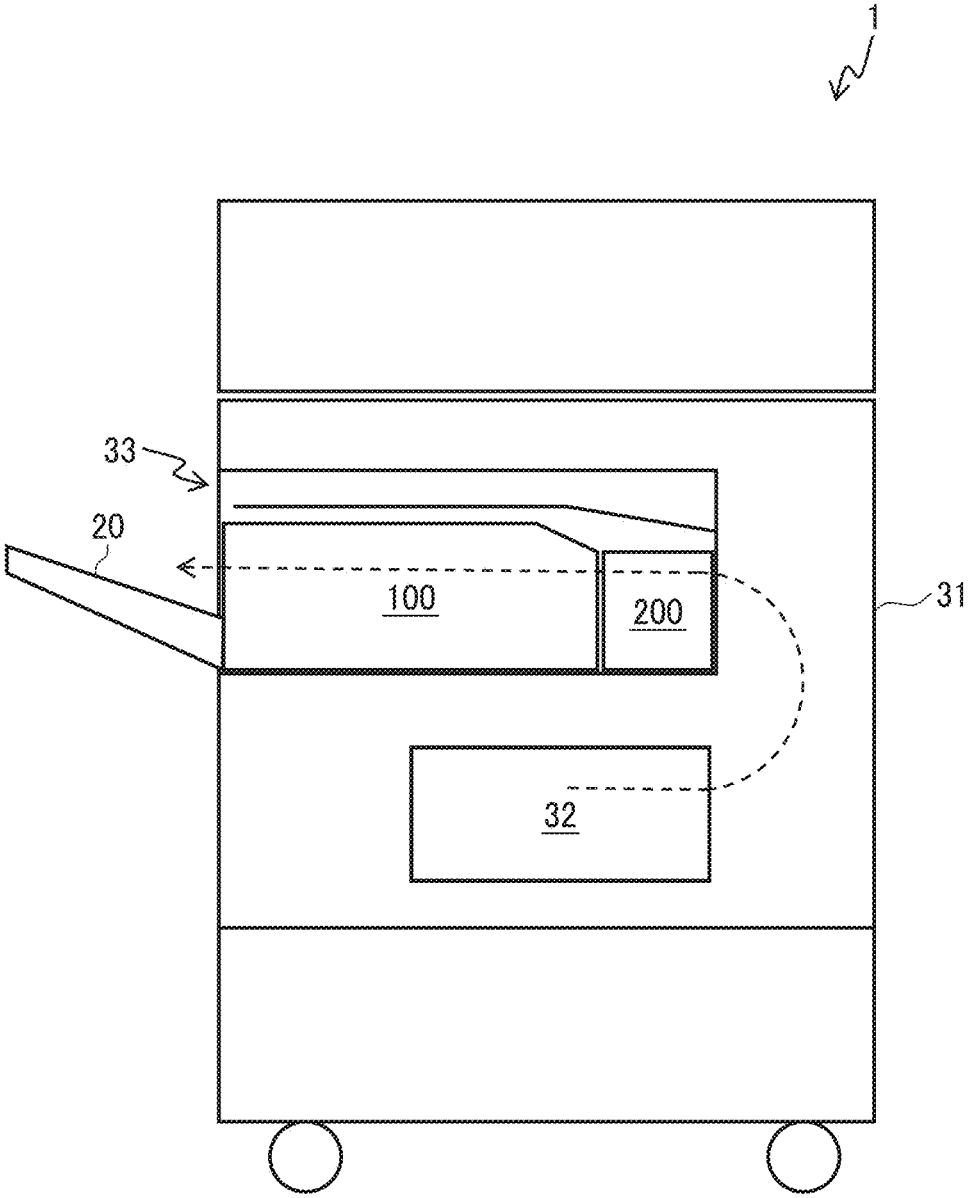
FIG. 1 is an external view of a multifunction printer (MFP) as an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Referring now to the drawings, embodiments of the present disclosure are described below. As used herein, the singular forms "a," "an," and "the" are intended to include the plural forms as well, unless the context clearly indicates otherwise.

Embodiment of Image Forming Apparatus

Figure 2:
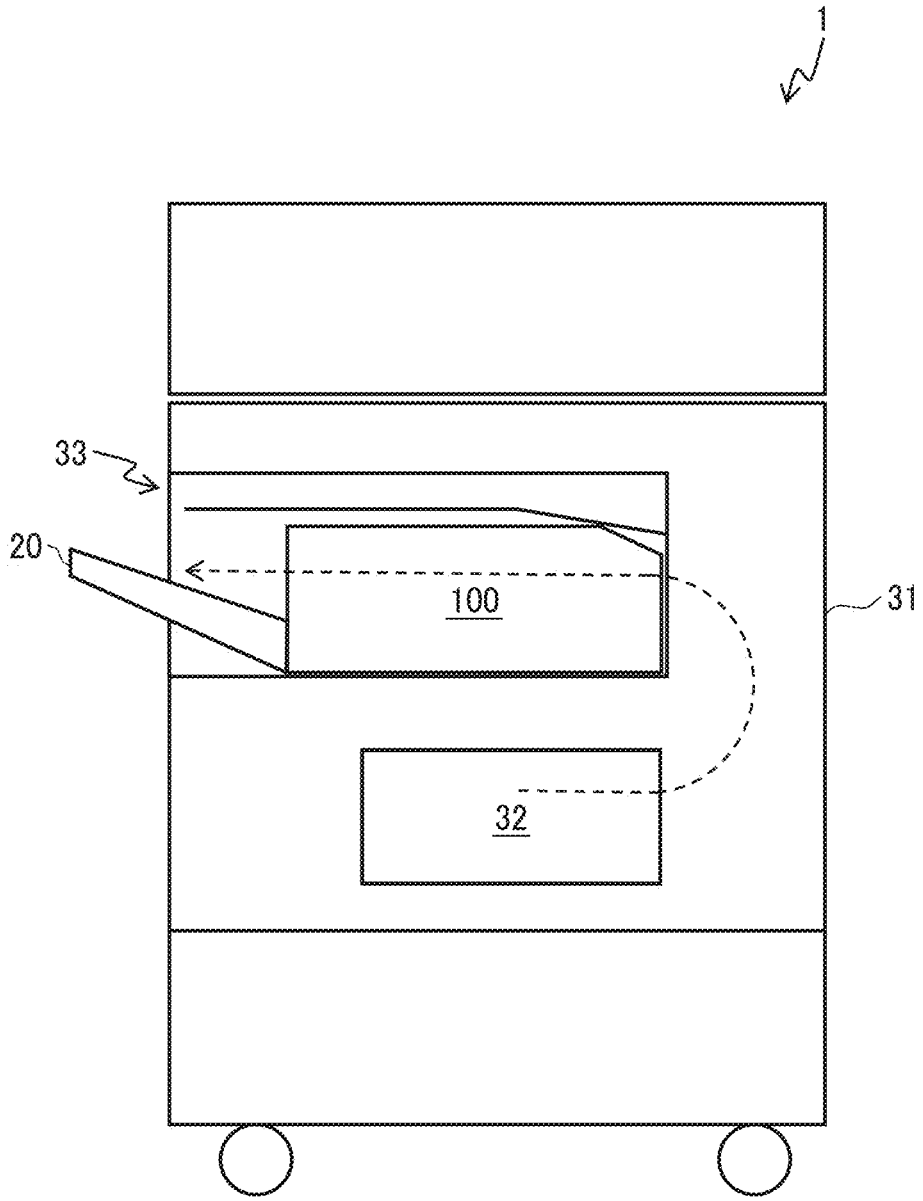
FIG. 2 is an external view of the MFP of FIG. 1 with a puncher.

Hereinafter, an MFP 1 constituting an embodiment of an image forming apparatus will be described with reference to the drawings. FIGS. 1 and 2 are external views of the MFP 1 according to the present embodiment. The MFP 1 is a device having an image forming function that forms an image on a sheet S (typically a sheet S) serving as a sheet medium, and a post-process function that executes predetermined sheet processing (post-process) on the sheet S on which an image is recorded.

As illustrated in FIG. 1, the MFP 1 mainly includes a housing 31 and an image former 32 inside the housing 31. The housing 31 is a box-shaped member in which an inner space for housing the components of the MFP 1 is formed. The housing 31 includes an internal space 33 which is accessible from the outside of the MFP 1. The internal space 33 is located, for example, slightly above the center of the housing 31 in the vertical direction. The internal space 33 is exposed to the outside by cutting out the outer wall of the housing 31.

A puncher 200, and a binding process unit 100 constituting an embodiment of the sheet processing apparatus can be attached to the internal space 33.

The image former 32 ejects the sheet S picked up and conveyed from the sheet storage tray to the puncher 200 and the binding process unit 100. The image former 32 may be an inkjet system that forms an image using ink, or may be an electrophotographic system that forms an image using toner. Because the configuration of the image former 32 is already known, a detailed description thereof will be omitted.

The puncher 200 is attached to the internal space 33 of the MFP 1 downstream from the image former 32 and upstream from the binding process unit 100 in the conveyance path of the sheet S from the image former 32 to the binding process unit 100 (the path indicated by the dashed arrow in FIG. 1). That is, the sheet S on which an image is formed by the image former 32 is first delivered to the puncher 200 to execute a predetermined punch-hole forming process, and then delivered to the binding process unit 100 to execute the binding process described below.

Further, the puncher 200 is detachable from the MFP 1. When the puncher 200 is removed, as illustrated in FIG. 2, the sheet S on which an image is formed by the image former 32 is directly delivered to the binding process unit 100 and subjected to the binding process. Another processing unit that performs an arbitrary process on the sheet S can be attached in the position in the internal space 33 where the puncher 200 is detached.

Figure 3:
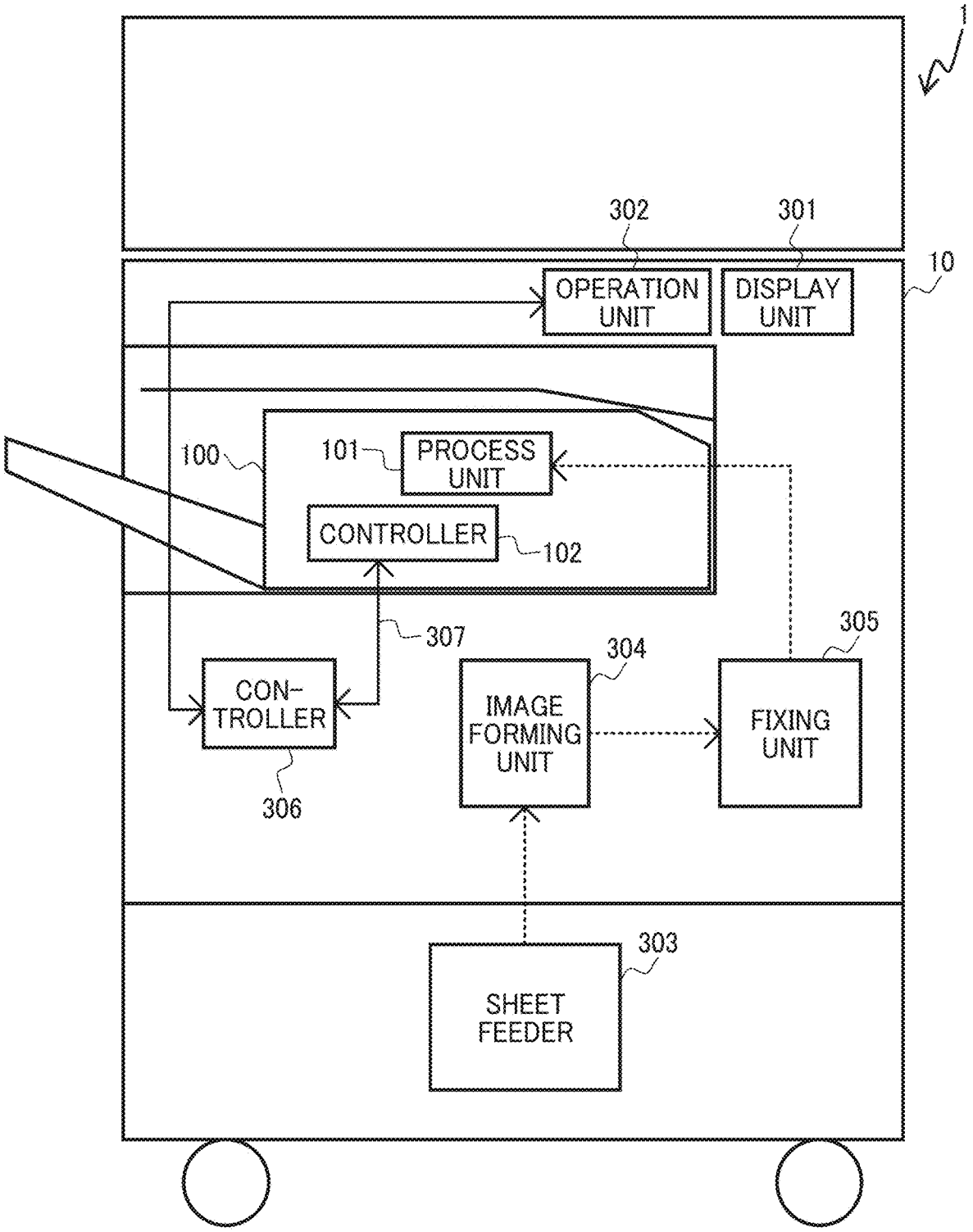
FIG. 3 is a functional block diagram of the MFP of FIG. 1.

Control Configuration of Sheet Processing Apparatus Including Image Forming Apparatus Next, a control configuration of the MFP 1 including the binding process unit 100 will be described with reference to FIG. 3. FIG. 3 is a diagram illustrating a control configuration of the MFP 1 in a state where the puncher 200 is removed.

In FIG. 3, the conveyance path (flow of the sheet S) of the sheet S is indicated by a broken line arrow, and the path (flow of the signal) of the communication signal (control signal) is indicated by a solid line arrow.

The MFP 1 includes a display unit 301 for notifying a user of states and operation content of various devices, an operation unit 302 for the user to perform an operation to set a mode and a number of copies, and a sheet feeder 303 that stocks the sheets S and separately feeds the sheets S one by one. The MFP 1 includes an image forming unit 304 that forms a latent image on a photoconductor (not illustrated in FIG. 3) and transfers the image to the sheet S, and a fixing unit 305 that fixes the image transferred to the sheet S. The MFP 1 further includes an image forming controller 306 that controls the operation of each unit described above.

The binding process unit 100, which constitutes an embodiment of the sheet processing apparatus, performs the designated processing on the sheet S in the post-process unit 101 when a process instruction is issued from the image forming controller 306 of the MFP 1 to the post-process controller 102 via the communication line 307.

The coupled image forming controller 306 and post-process controller 102 are coupled together via a communication line 307, and can exchange information with each other. As a result, information regarding the post-process operation mode, and information such as the size of the sheet S and the delivery timing of the sheet S are exchanged, thus enabling the system operation.

Hardware Configuration of MFP1

Next, a hardware configuration of the binding process unit 100 included in the MFP 1 will be described with reference to FIG. 4. As illustrated in the drawing, the binding process unit 100 includes a CPU 110 as a controller, and is coupled to a plurality of motors serving as power sources for operation of each mechanism via an interface (I/F) 120. The CPU 110 is an arithmetic unit and controls the entire operation of the binding process unit 100.

The CPU 110 in the binding process unit 100 is connected to the image forming controller 306 of the MFP 1 via the I/F 120, and controls the binding process unit 100 according to a processing signal from the MFP 1. Because the binding process unit 100 is also an optional device, it has a detachable hardware configuration.

Each motor is provided with an encoder capable of detecting a motor driving amount from the number of pulses, and can be stopped in the position of a specific driving amount starting from a specific timing. The driving amount of each motor is calculated on the basis of an encoder pulse by taking, as a reference, the timing when the sensor on the conveyance path is turned on or off, and the position of the end of a sheet S being conveyed can be detected on the basis of the driving amount.

Figure 4:
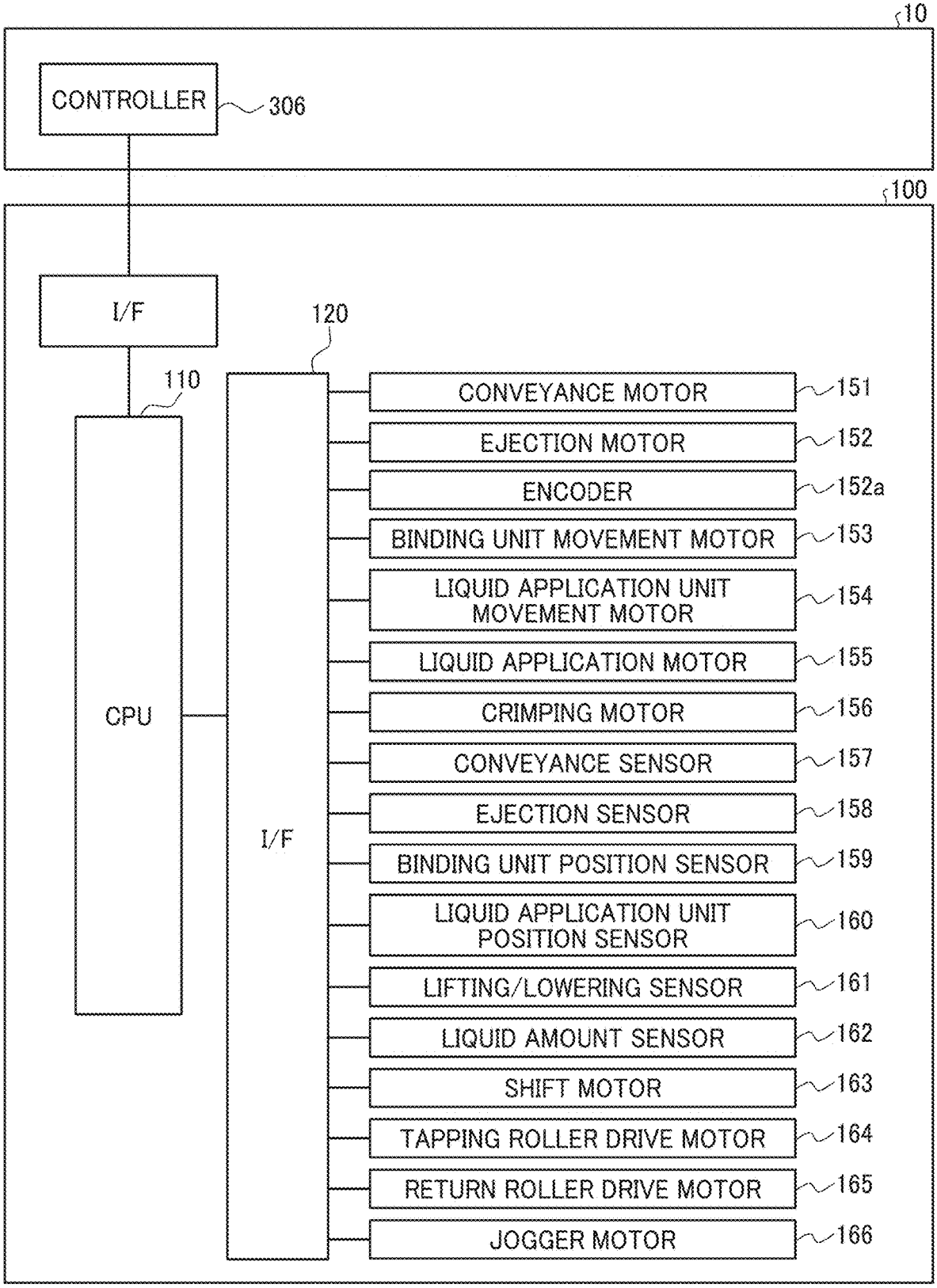
FIG. 4 is a functional block diagram of a binding process unit.

As illustrated in FIG. 4, the binding process unit 100 is connected via the I/F 120 to a conveyance motor 151, an ejection motor 152, a binding unit movement motor 153, a liquid application unit movement motor 154, a liquid application motor 155, a crimping motor 156, a conveyance sensor 157, an ejection sensor 158, a binding unit position sensor 159, a liquid application unit position sensor 160, a lifting/lowering sensor 161, a liquid amount sensor 162, a shift motor 163 for moving (shifting) the shift roller 13 in the main scanning direction, a tapping roller driving motor 164 for driving vertical movement and rotation of a tapping roller 15, a return roller driving motor 165 for driving the return roller 14, and a jogger motor 166 for moving a jogger fence 22 in the main scanning direction.

Conveyance Path Configuration of Binding Process Unit 100

Figure 5:
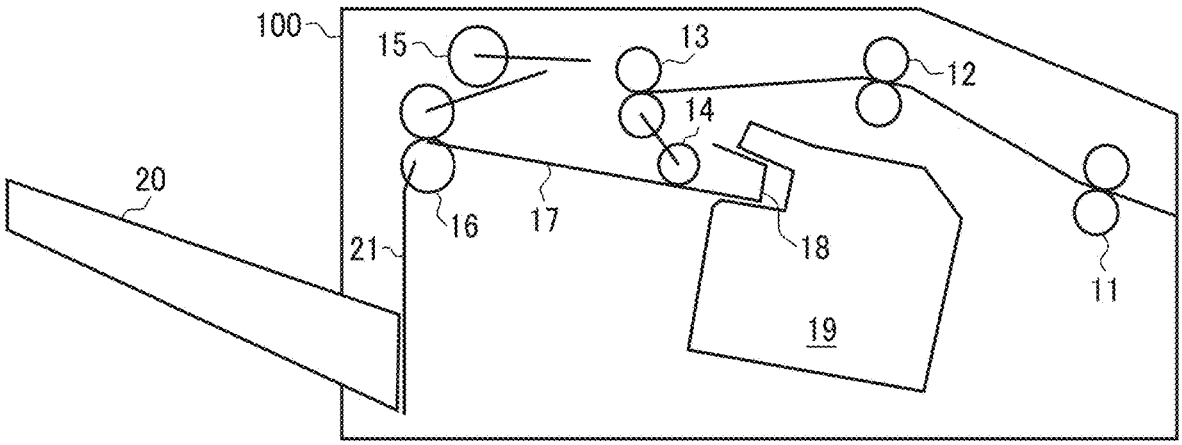
FIG. 5 is a cross-sectional configuration diagram of a binding process unit.

Next, a configuration of a conveyance path of the sheet S included in the binding process unit 100 constituting an embodiment of the sheet processing apparatus will be described. FIG. 5 is a cross-sectional view of a conveyance path included in the binding process unit 100. The binding process unit 100 can set a plurality of operation modes, and operates appropriately on the basis of the set operation modes. The operation modes of the binding process unit 100 include, for example, a "shift ejection mode" in which the sheet S is conveyed and ejected, without the binding process being performed on the sheet S, from upstream (image former 32) to the ejection tray 20, and a "crimp binding mode" in which a crimping unit 19 performs crimp binding on the sheet S.

In the shift ejection mode, the sheet S conveyed from the MFP 1 is received by the inlet roller 11, conveyed to the ejection roller 16, and ejected to the ejection tray 20. The inlet roller 11, the conveyance roller 12, the shift roller 13, and the ejection roller 16 constitute a first conveyor. That is, when the sheet S is conveyed from the inlet roller 11 toward the ejection roller 16, the conveyance direction corresponds to the first direction.

In the case of the crimp binding mode, the sheet S conveyed from the MFP 1 is received by the inlet roller 11 and conveyed to the shift roller 13 in the first direction, and when the sheet S comes off the shift roller 13, the tapping roller 15 is driven to bring the sheet S into a state of being placed on a stacking tray 17, which serves as an internal tray. Thereafter, the sheet S is conveyed in a second direction different from the first direction by the operations of the tapping roller 15 and the return roller 14 which serve as second conveyors. The second direction at this time is conveyance toward the reference fence 18 for aligning the end of the sheet S and is conveyance corresponding to a direction opposite to the first direction, and thus corresponds to "switchback conveying".

In the case of the crimp binding mode, the conveyance operation of the sheet S in a second direction (operation of conveying the sheet S to the reference fence 18 along the stacking tray 17) is repeatedly executed until a number of bound sheets is reached. When the final sheet S is conveyed to the reference fence 18, the end of the bundle of sheets S (sheet bundle Sb) is pressure-deformed by the crimping unit 19 serving as a crimper, and a crimp binding process is executed without using a binding member. The bound sheet bundle Sb is conveyed in the first direction by the ejection roller 16 constituting the first conveyor and is ejected to the ejection tray 20.

The sheet S or the sheet bundle Sb ejected to the ejection tray 20 is aligned by the end of the sheet S or the sheet bundle Sb abutting on the end fence 21.

Operation Step in Shift Ejection Mode

Figure 6:
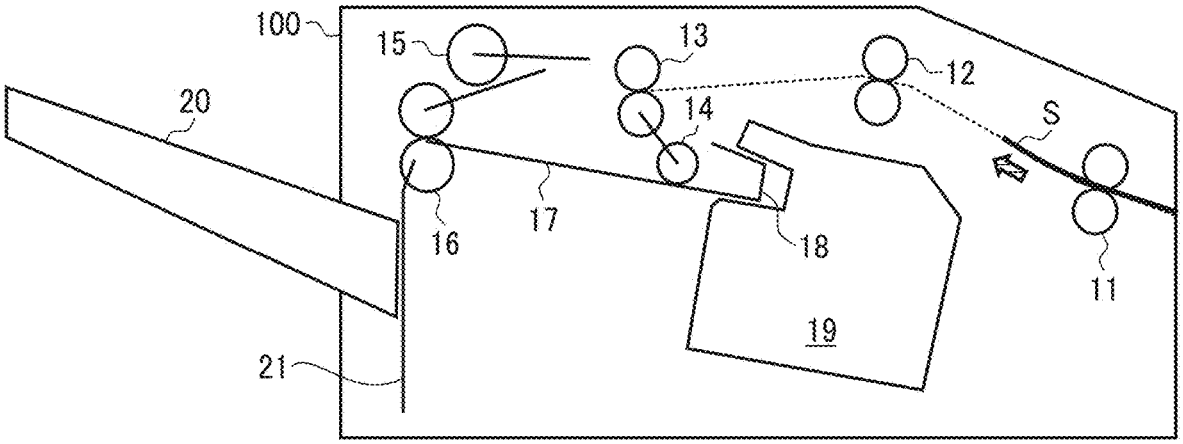
FIG. 6 is a diagram illustrating an operation step of the binding process unit of FIG. 5.

Next, an operation step of a shift ejection mode in the conveyance process and the binding process of the sheet S in the binding process unit 100 will be described with reference to a plurality of drawings. First, as illustrated in FIG. 6, the sheet S is received by the binding process unit 100 and conveyed in the first direction. This state is similar regardless of the operation mode.

Figure 7A:
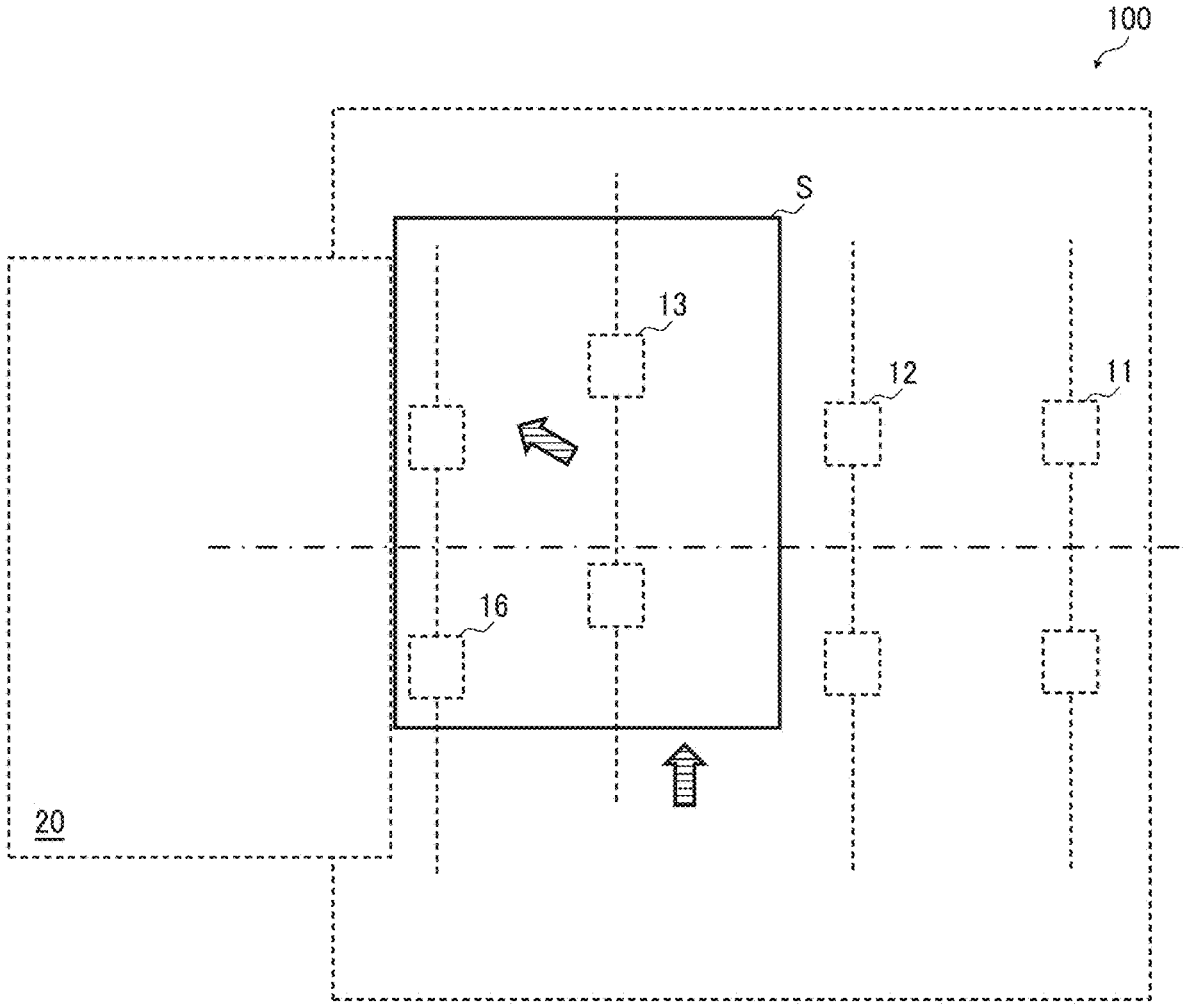
FIGS. 7A and 7B are diagrams illustrating an operation step of the binding process unit of FIG. 5.
Figure 7B:
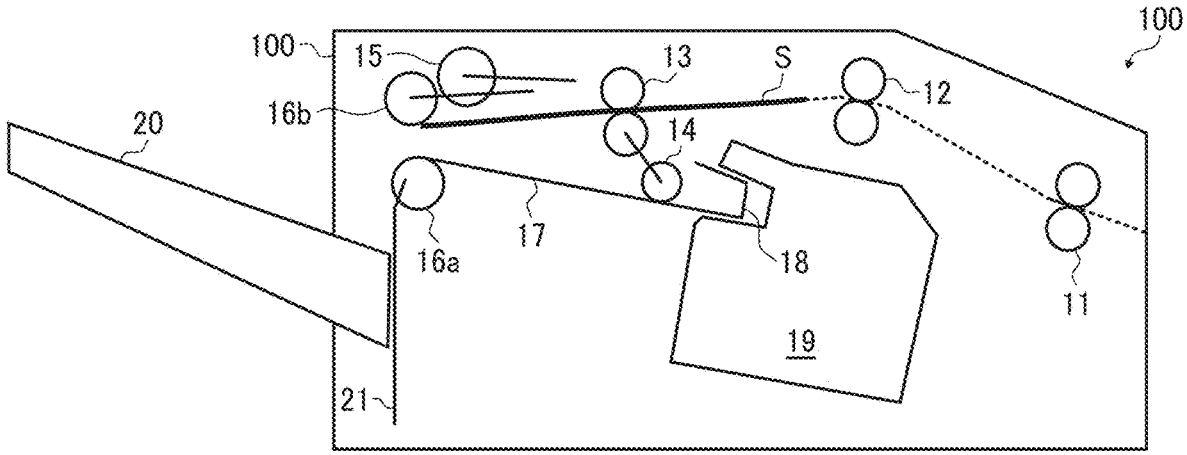

Subsequently, the state of FIGS. 7A and 7B is reached. FIG. 7A is a view of the binding process unit 100 as viewed from the thickness direction, and is a plan view of the conveyance path. FIG. 7B is a view of the binding process unit 100 as viewed from the main scanning direction, and is a side view of the conveyance path. The main scanning direction is a direction intersecting with the first direction, and corresponds to the width direction of the sheet S when the sheet S is conveyed in the first direction. That is, in FIG. 7A, the main scanning direction is the vertical direction in the drawing, and in FIG. 7B, the main scanning direction is the direction toward the back side and the front side in the drawing.

As illustrated in FIGS. 7A and 7B, when the sheet S is conveyed in the first direction and the leading end in the conveyance direction reaches the position of the ejection roller 16, the ejection driven roller 16*b* transitions from a nip state in which same is close to the ejection driving roller 16*a* to a nip pressure release state in which same is separated from the ejection driving roller 16*a*. By moving the shift roller 13 in the width direction (main scanning direction) of the sheet S in a state where the rear end of the sheet S passes through the conveyance roller 12, the sheet S is conveyed while the conveyance position of the sheet S is shifted in the main scanning direction.

In FIG. 7A, shift conveyance is performed from the conveyance center to the far side (upper side in FIG. 7). The shift roller 13, which serves as a media shifter, can perform shift conveyance to either the front side (the lower side in FIG. 7A) or the back side, and can perform an ejection process known as a sorting process to shift the ejection position for each portion of the sheet bundle Sb by switching the shift direction for each sheet or for each plurality of sheets.

Figure 8:
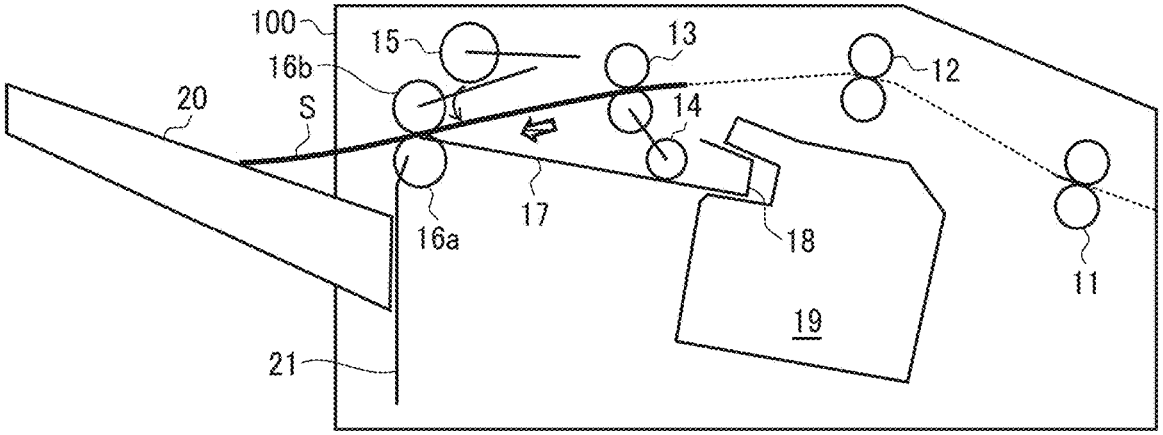
FIG. 8 is a diagram illustrating an operation step of the binding process unit of FIG. 5.

Subsequently, as illustrated in FIG. 8, when the shifting of the sheet S is complete, the ejection driven roller 16*b* is moved to the nip position, and the sheet S is conveyed toward the ejection tray 20.

Figure 9:
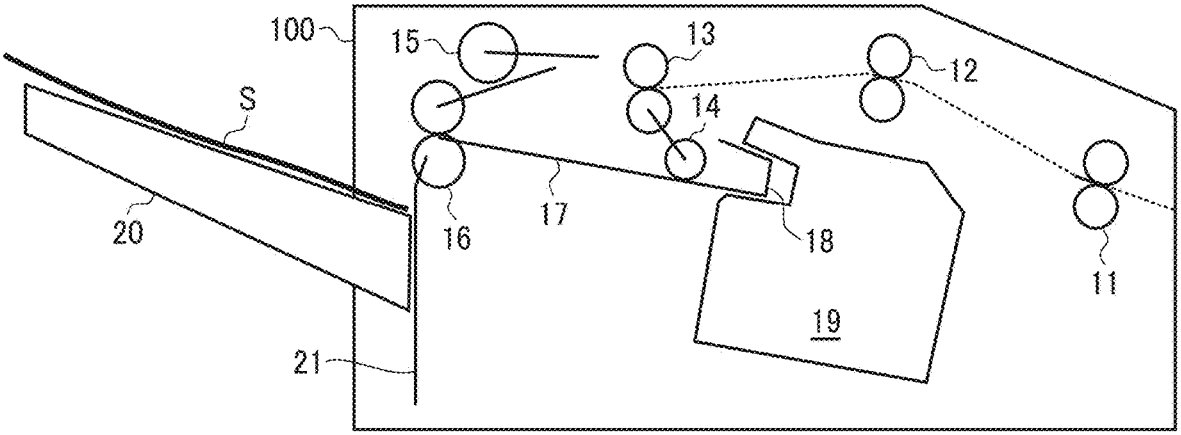
FIG. 9 is a diagram illustrating an operation step of the binding process unit of FIG. 5.

Subsequently, as illustrated in FIG. 9, the sheet S is ejected to the ejection tray 20 by the ejection roller 16.

As described above, when the binding process unit 100 operates in the shift ejection mode, the sheet S is conveyed only in the first direction.

Operation Step of Crimp Binding Mode

Figure 10:
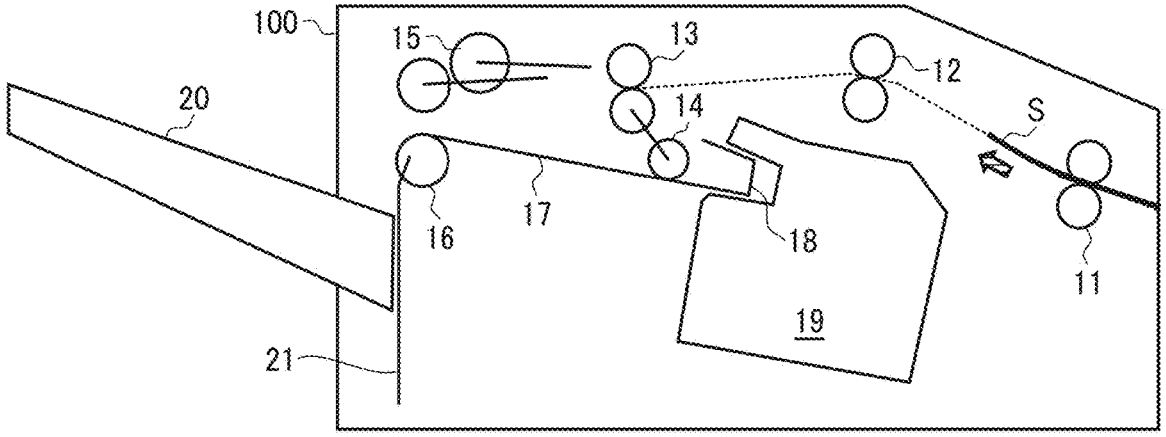
FIG. 10 is a diagram illustrating an operation step of the binding process unit of FIG. 5.

Next, an operation step of a crimp binding mode in the conveyance process and the binding process of the sheet S in the binding process unit 100 will be described with reference to a plurality of drawings. FIG. 10 is similar to FIG. 6 described above, and illustrates a state in which the sheet S is received in the binding process unit 100.

Figure 11:
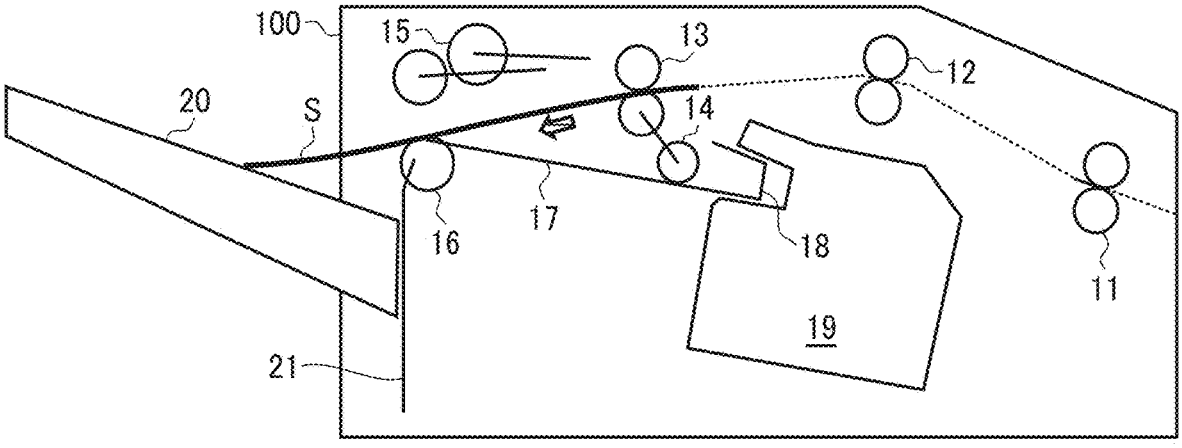
FIG. 11 is a diagram illustrating an operation step of the binding process unit of FIG. 5.

Subsequently, as illustrated in FIG. 11, in the crimp binding mode, because the sheet S is conveyed without being shifted, the ejection driven roller 16*b* remains in the nip pressure release position, and the sheet S is conveyed in the first direction.

Figure 12:
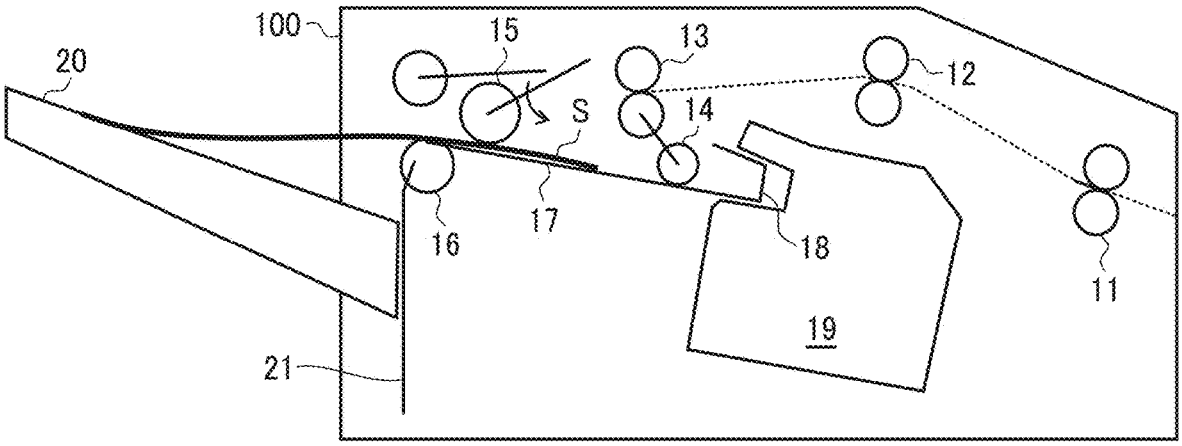
FIG. 12 is a diagram illustrating an operation step of the binding process unit of FIG. 5.

Subsequently, as illustrated in FIG. 12, the sheet S with the rear end removed falls, under its own weight, from the shift roller 13 onto the stacking tray 17 serving as an internal tray. The tapping roller 15 then comes into contact with the sheet S placed on the stacking tray 17 and conveys the sheet S in the second direction. As a result, the sheet S is switchback-conveyed toward the reference fence 18 while placed on the stacking tray 17.

Figure 13A:
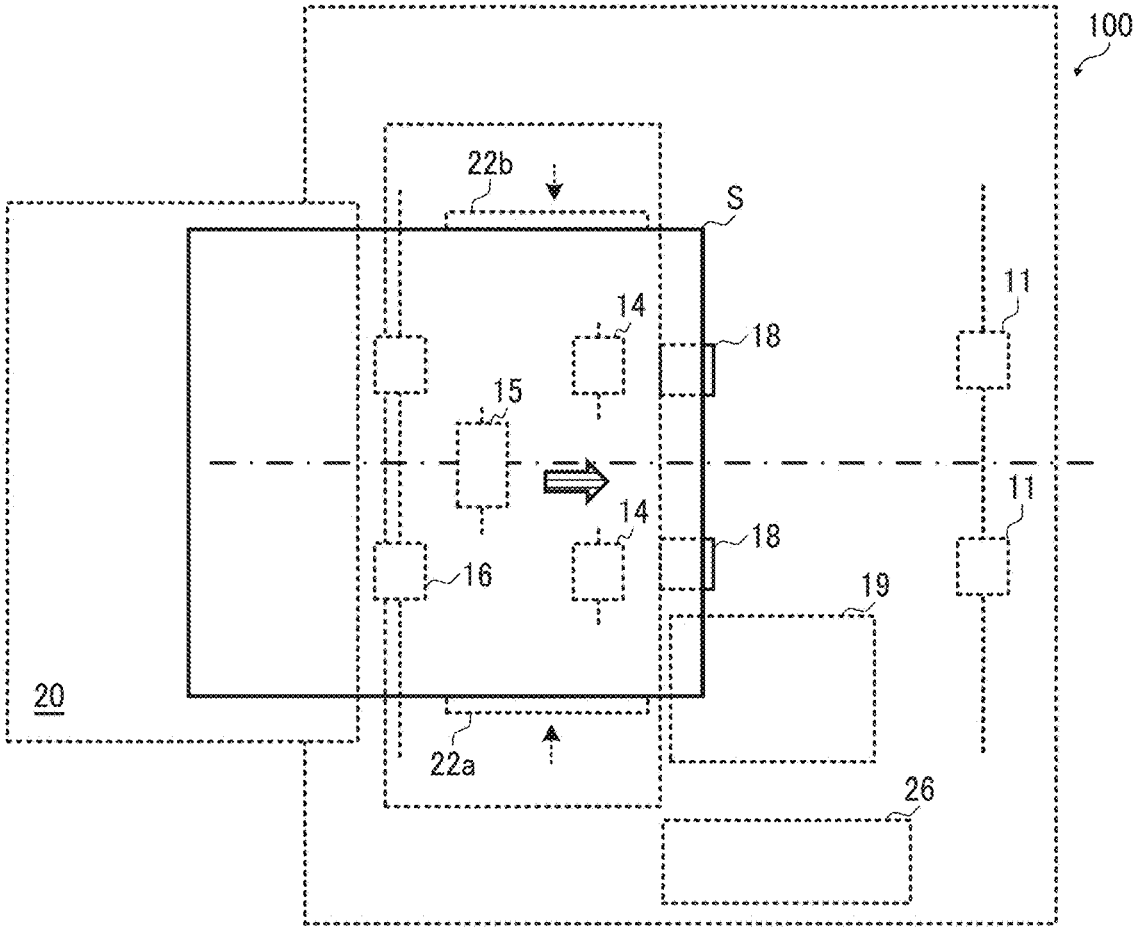
FIGS. 13A and 13B are diagrams illustrating an operation step of the binding process unit of FIG. 5.
Figure 13B:
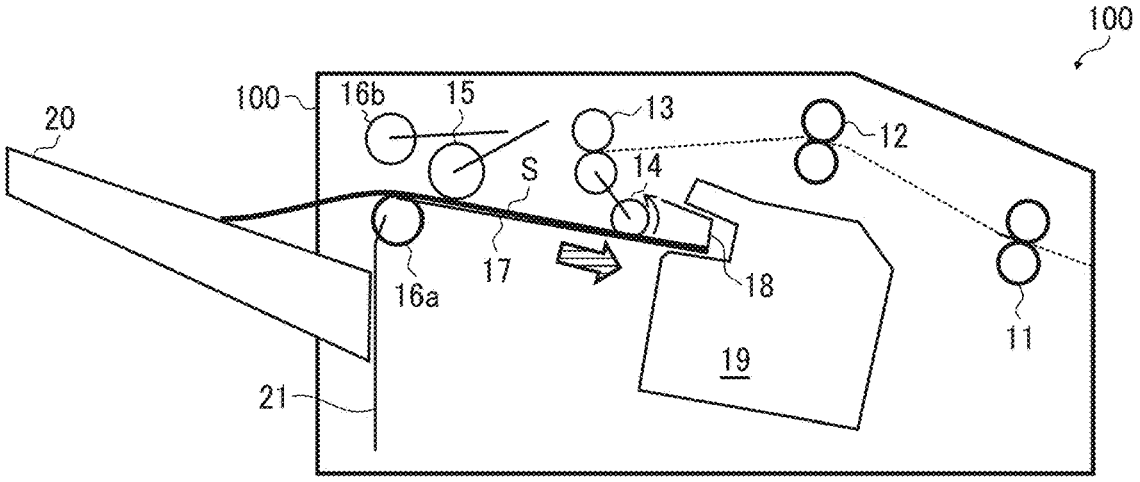

Subsequently, as illustrated in FIGS. 13A and 13B, the sheet S is conveyed until the end (the end corresponding to the head in the conveyance in the second direction) of the sheet S abuts on the reference fence 18 due to the switchback conveying by the tapping roller 15 and the return roller 14. After the end of the sheet S abuts on the reference fence 18, the sheet S is sandwiched by the jogger fence 22 so as to abut on the lateral (width direction) end of the sheet S. Through this operation, the ends in the width direction of the sheets S stacked on the stacking tray 17 are aligned.

Figure 14:
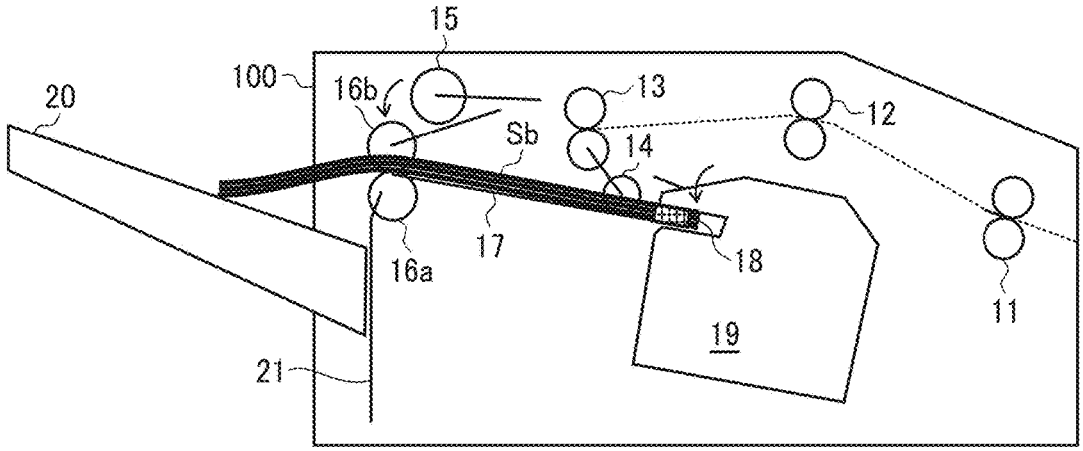
FIG. 14 is a diagram illustrating an operation step of the binding process unit of FIG. 5.

By repeatedly executing the processes of FIGS. 10 to 13, a plurality of sheets S comes to be stacked on the stacking tray 17. Here, the number of repetitions corresponds to the number of sheets S for forming the sheet bundle Sb. Subsequently, as illustrated in FIG. 14, the sheets S are stacked on the stacking tray 17, and then the crimping unit 19 is used to perform crimp binding on a portion (a portion of the end) of the sheet bundle Sb. When performing the crimp binding, the ejection driven roller 16*b* moves to the nip position.

Figure 15:
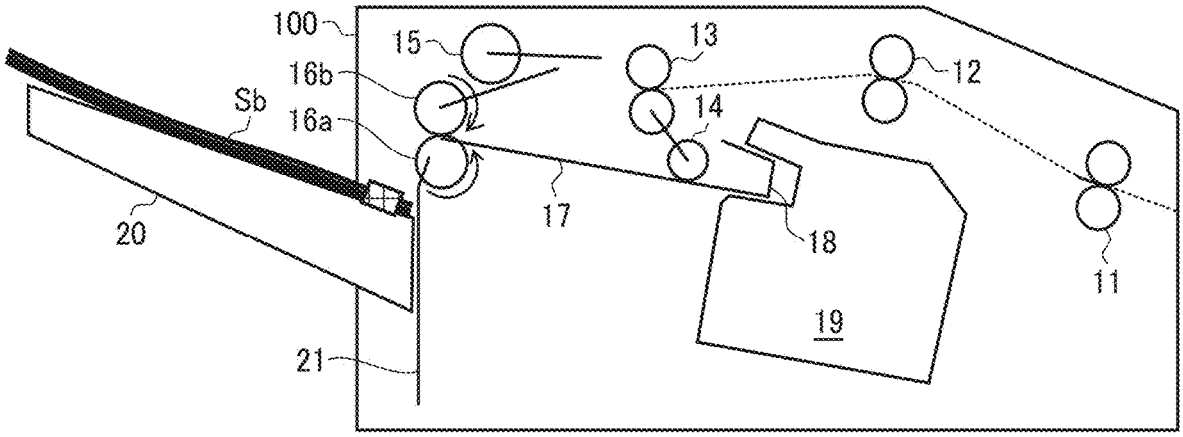
FIG. 15 is a diagram illustrating an operation step of the binding process unit of FIG. 5.

Subsequently, as illustrated in FIG. 15, the sheet bundle Sb is ejected to the ejection tray 20 by the ejection roller 16.

Embodiment of Sheet Processing Apparatus

Next, a binding process unit 100 constituting an embodiment of the sheet processing apparatus will be described in more detail. An outline of operations of the crimping unit 19 serving as a crimp binder and the liquid application unit 26 serving as a liquid applier, which are included in the binding process unit 100, will be described. The liquid application unit 26 applies liquid (for example, water) stored in a liquid storage tank included in the liquid application unit 26 to a portion (binding portion) of the sheet bundle Sb to which the binding process is performed by the crimping unit 19. Hereinafter, the act of applying liquid to the binding portion is referred to as "liquid application".

Here, the liquid stored in the liquid storage tank for performing the "liquid application" is more specifically a liquid having, as a main component, a liquid state of a compound of hydrogen and oxygen represented by the chemical formula H2O. The liquid hydrogen-oxygen compound is at any temperature. For example, the liquid hydrogen-oxygen compound may be so-called warm water or hot water. The liquid hydrogen-oxygen compound is not limited to pure water. The liquid hydrogen-oxygen compound may be purified water or may contain ionized salts. The metal ion content ranges from so-called soft water to ultrahard water. In other words, the liquid hydrogen-oxygen compound is at any hardness.

The liquid that is stored in the liquid storage tank may include an additive in addition to the main component. The liquid that is stored in the liquid storage tank may include residual chlorine used as tap water. Preferably, for example, the liquid that is stored in the liquid storage tank may include, as an additive, a colorant, a penetrant, a pH adjuster, a preservative such as phenoxyethanol, a drying inhibitor such as glycerin, or a combination thereof. Because water is used as a component of ink used for inkjet printers or of ink used for water-based pens, such water or ink may be used for the "liquid application".

The water is not limited to the specific examples described above. The water may be water in a broad sense such as hypochlorous acid water or an ethanol aqueous solution diluted for disinfection. However, tap water may be used simply for the crimp binding because tap water is easy to obtain and store. Further, the use of a liquid containing water as a main component as exemplified above can improve the binding strength of the sheet bundle Sb in comparison with the use of a liquid that does not contain water as a main component.

Figure 16:
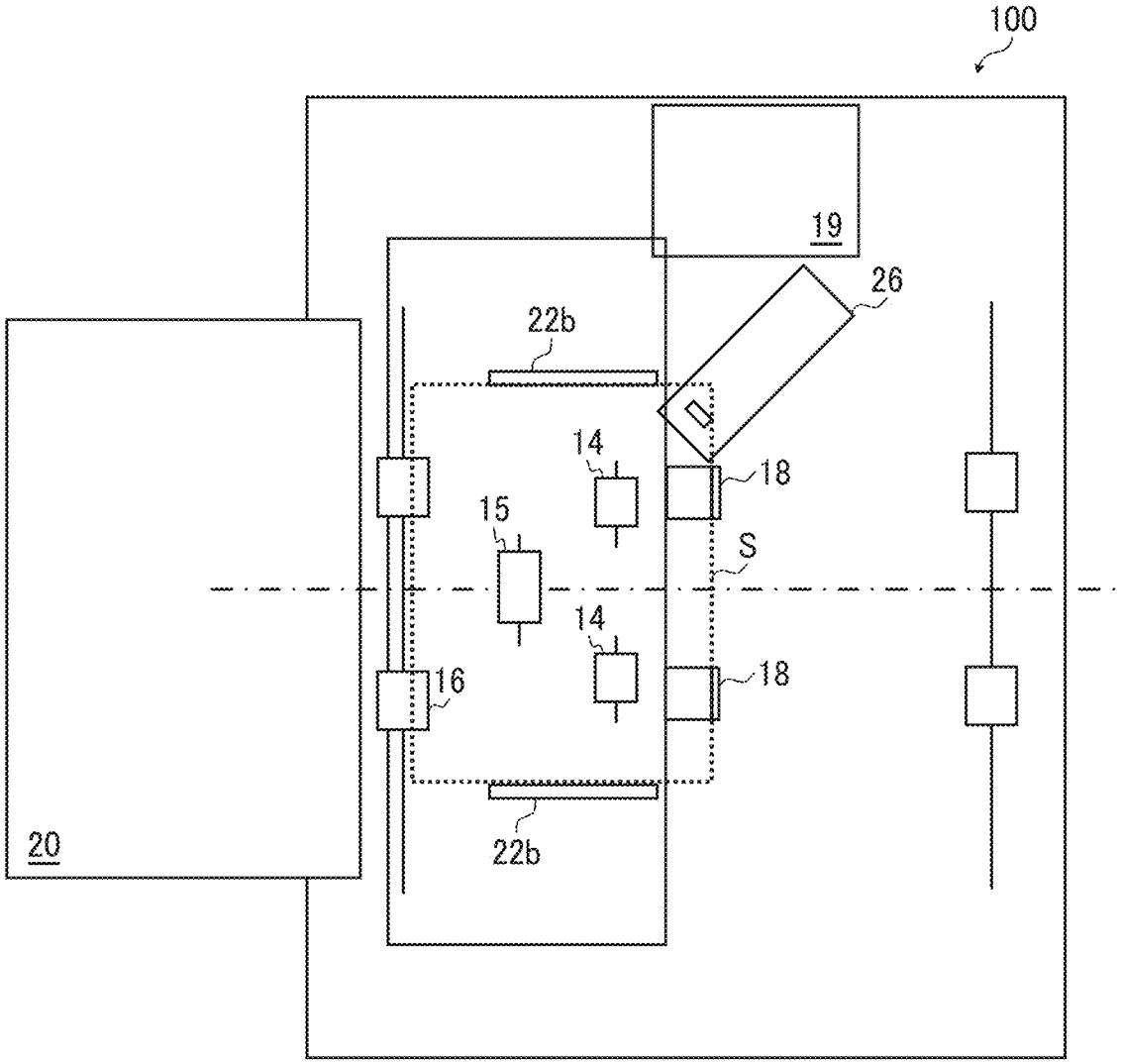
FIG. 16 is a diagram illustrating an operation step of the binding process unit of FIG. 5.
Figure 17:
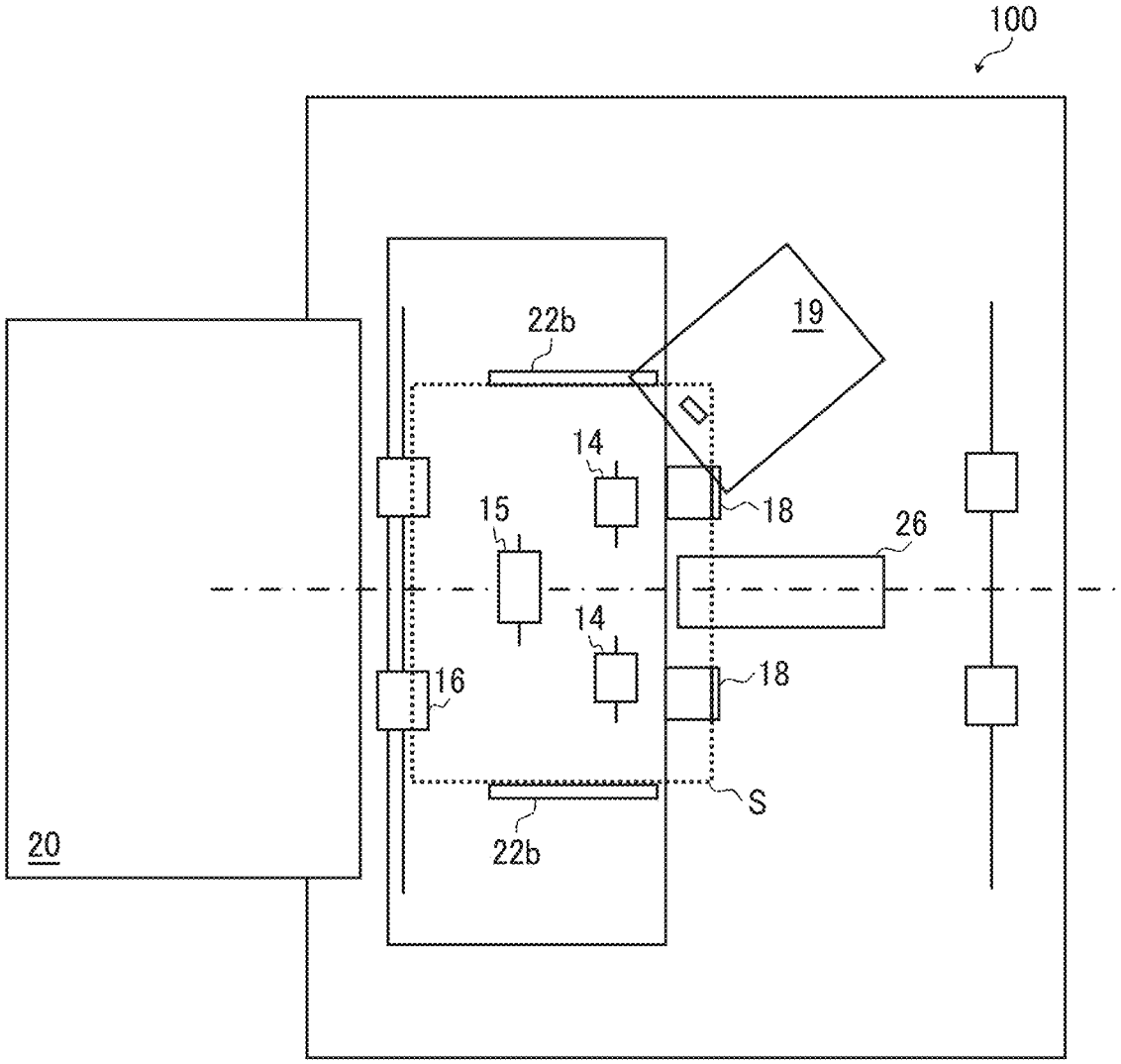
FIG. 17 is a diagram illustrating an operation step of the binding process unit of FIG. 5.
Figure 18:
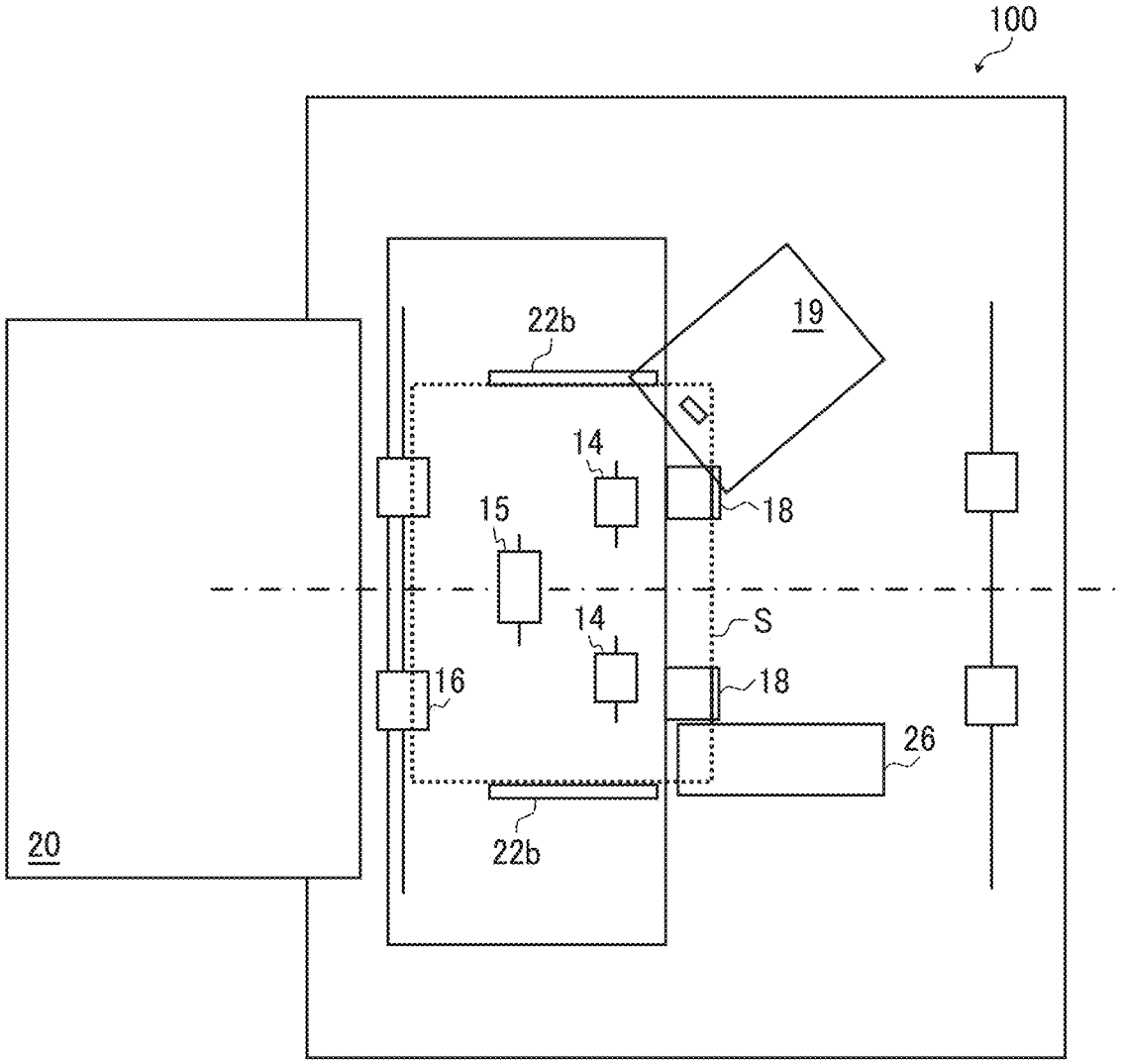
FIG. 18 is a diagram illustrating an operation step of the binding process unit of FIG. 5.

FIGS. 16, 17, and 18 are plan views of the binding process unit 100. As illustrated in FIG. 16, in a state where the sheet S is being conveyed to the stacking tray 17 and the rear end abuts on the reference fence 18, the liquid application unit 26 applies the liquid to a portion (binding portion) of the sheet S. At this time, the crimping unit 19 is located on the back side (upper side in the drawing) of the binding process unit 100 with respect to the liquid application unit 26.

After the liquid application, as illustrated in FIG. 17, the liquid application unit 26 moves to the front side (downward in the drawing). The crimping unit 19 moves to the binding position and executes the crimp binding process. In a case where the crimping unit 19 moves to the binding position, the liquid application unit 26 may be moved to an end on the front side (lower side in the drawing) opposite to the binding position as illustrated in FIG. 18.

Note that the positional relationship between the crimping unit 19 and the liquid application unit 26 is not limited to that illustrated in FIGS. 16, 17, and 18, rather, the crimping unit 19 and the liquid application unit 26 may be arranged interchangeably. That is, as illustrated in FIG. 16, when the liquid application unit 26 is located in the liquid application position (binding position), the crimping unit 19 may be controlled to retreat to the lower side (front side) in the drawing.

Figure 19:
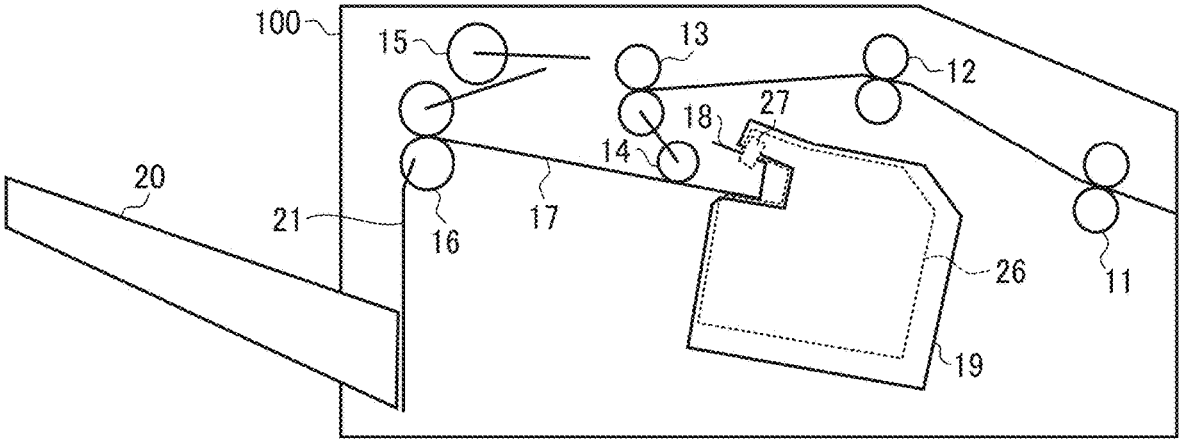
FIG. 19 is a diagram illustrating an operation step of the binding process unit of FIG. 5.

FIG. 19 is a cross-sectional view of the binding process unit 100. As illustrated in FIG. 19, when the binding process unit 100 is viewed from the main scanning direction, the crimping unit 19 and the liquid application unit 26 are in positions movable along the rear end of the sheet S, the ends of which have been aligned by the reference fence 18, and are movable in the main scanning direction. Therefore, in a case where the liquid is to be applied, the crimping unit 19 retreats to a position that does not interfere with the operation of the liquid application unit 26. In a case where the crimp binding process is to be performed, the liquid application unit 26 retreats to a position where the operation of the crimping unit 19 is not disturbed. That is, the crimping unit 19 and the liquid application unit 26 each retreat to positions preventing mutual interference.

So too in the following description, the binding process unit 100 includes the crimping unit 19 and the liquid application unit 26, but for convenience of description, illustration of the crimping unit 19 or the liquid application unit 26 may be omitted in some drawings.

Operation Step in Crimp Binding Mode

Next, an operation step when an operation in the crimp binding mode is to be performed in the binding process unit 100 will be described with reference to a plurality of drawings. The operations from FIG. 10 to FIG. 14 that have already been described are similar in the present embodiment, and thus a detailed description is omitted.

Figure 20:
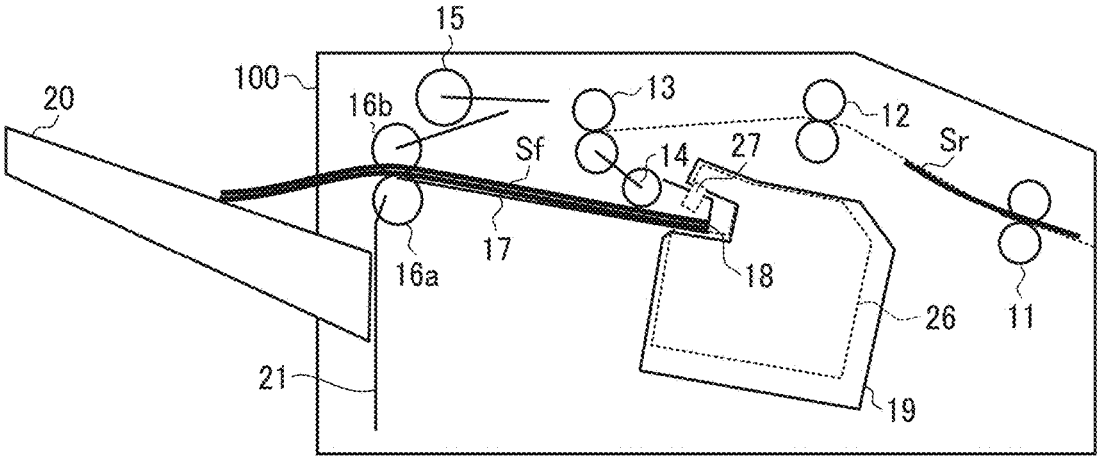
FIG. 20 is a diagram illustrating an operation step of the binding process unit of FIG. 5.

FIG. 20 is a process step after aligning the sheet S conveyed from the MFP 1 on the stacking tray 17 similarly to the state illustrated in FIG. 14. A state (pressing state) in which the liquid application head 27 of the liquid application unit 26 is closed to make contact with and press the rear end of the sheet S is illustrated. In this state, as described with reference to FIG. 16, there is a method in which the rear end of the sheet bundle Sb is pressed by arranging the liquid application unit 26 in the position of the end of the sheet bundle Sb and the liquid application head 27 is made to operate in that position to sandwich the sheet bundle Sb with the stacking tray 17.

Alternatively, as described with reference to FIG. 17, there is a method in which the liquid application head 27 is moved to the vicinity of the center of the sheet bundle Sb in the width direction, and the liquid application head 27 is operated in that position to sandwich the sheet bundle Sb with the stacking tray 17.

As yet another method, as described with reference to FIG. 18, the liquid application head 27 is moved to another end of the sheet bundle Sb, and the liquid application head 27 is operated in that position to sandwich the end of the sheet bundle Sb with the stacking tray 17. Further, there is a method in which the end of the sheet bundle is pressed in a plurality of positions due to the other end being sandwiched by the crimping unit 19.

Figure 21:
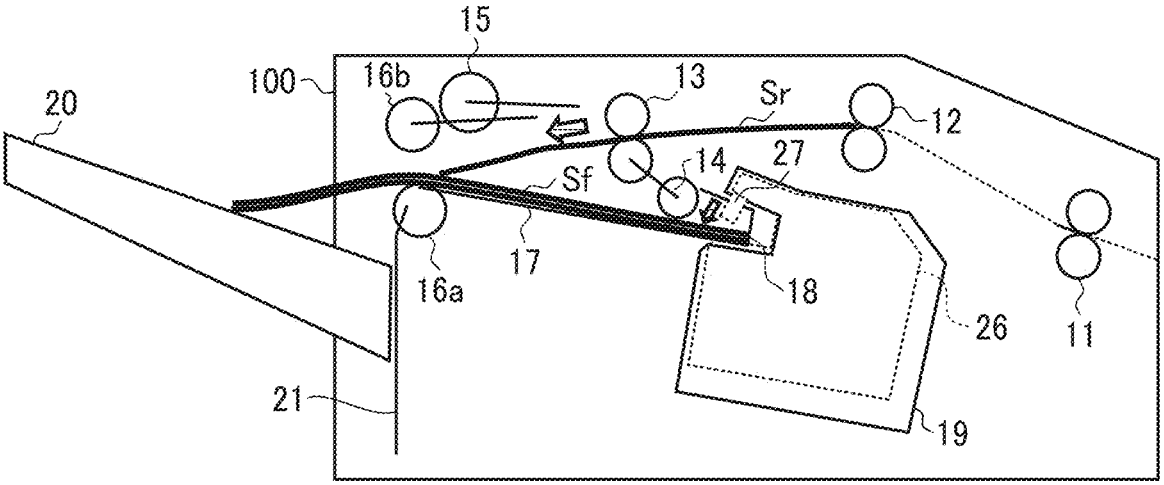
FIG. 21 is a diagram illustrating an operation step of the binding process unit of FIG. 5.

Following the state of FIG. 20, as illustrated in FIG. 21, the next sheet S is conveyed in a state where the end (rear end) of the sheet bundle Sb stacked on the stacking tray 17 is pressed. In the following description, among the sheets S already placed on the stacking tray 17, the sheet S corresponding to the uppermost surface is referred to as a "preceding sheet Sf", and the sheet S newly conveyed to be placed on the preceding sheet Sf is referred to as a "subsequent sheet Sr".

When the subsequent sheet Sr, which serves as a subsequent medium, is conveyed in the first direction with respect to the preceding sheet Sf, which serves as a preceding medium, the subsequent sheet Sr moves in the first direction while being in contact with the preceding sheet Sf. In a case where the subsequent sheet Sr moves while being in contact with the preceding sheet Sf in this manner, friction or static electricity generated between the preceding sheet Sf and the subsequent sheet Sr may push and move the preceding sheet Sf in the first direction which is the conveyance direction of the subsequent sheet Sr. The preceding sheet Sf moves in the first direction from a state where the ends of the preceding sheet Sf are already aligned in the sheet bundle Sb, and thus the ends of the preceding sheet Sf are displaced.

Therefore, the end (rear end) of the sheet bundle Sb is held down by being pressed by the liquid application head 27 according to the timing when the subsequent sheet Sr comes into contact with the preceding sheet Sf. Through this pressing, it is possible to suppress the preceding sheet Sf from being pushed out in the first direction by being followed by the subsequent sheet Sr. That is, by holding down (pressing) the end of the preceding sheet Sf by means of the liquid application head 27 according to the conveyance timing of the subsequent sheet Sr, it is possible to suppress the disturbance of the alignment of the preceding sheet Sf.

Figure 22:
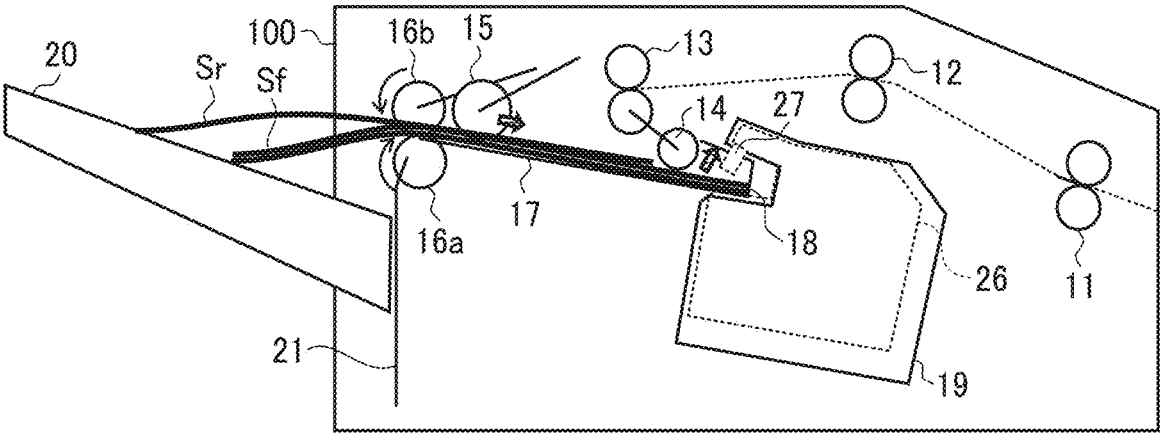
FIG. 22 is a diagram illustrating an operation step of the binding process unit of FIG. 5.

Subsequently, as illustrated in FIG. 22, the subsequent sheet Sr is ejected toward the stacking tray 17 in a state where the rear end of the sheet bundle Sb has been released from the pressing state by the liquid application unit 26. The subsequent sheet Sr is then tapped under the action of the tapping roller 15 and is switchback-conveyed toward the reference fence 18.

In a case where switchback conveying is to be performed, the liquid application head 27 of the liquid application unit 26 is brought into the separated state and the pressing of the end of the sheet bundle Sb is released, and thus even if friction or static electricity is generated between the preceding sheet Sf and the subsequent sheet Sr, the preceding sheet Sf is also conveyed in the second direction by the switchback conveying (conveyance in the second direction) of the subsequent sheet Sr. As a result, the subsequent sheet Sr is conveyed together with the preceding sheet Sf to a position where the rear end abuts on the reference fence 18 and is aligned.

The timing when the liquid application head 27 of the liquid application unit 26 is separated may be the same time as the start of the switchback conveying, or may be immediately before the subsequent sheet Sr abuts on the reference fence 18 without being raised immediately after the start of the switchback conveying. In the case of timing immediately before abutment on the reference fence 18, the encoder of the ejection motor 152 driving the ejection roller 16 may be used as a media detector. The position of the sheet S may be calculated by detecting the output from the encoder of the motor that drives the tapping roller 15 and the return roller 14.

The output pulse of the encoder is always detected, and the conveyance distance of the subsequent sheet Sr in the switchback conveying is calculated. As the conveyance distance in this case, a mechanical configuration distance is used which extends from the position of the calculated end of the sheet S (the end on the reference fence side of the binding tray) at the time the switchback conveying is started to the reference fence 18. It is calculated, on the basis of an encoder pulse, whether or not a conveyance distance has been reached, the conveyance distance corresponding to a distance obtained by subtracting, from the mechanical configuration distance, a distance provided with a margin preventing a sheet S, which has been switched back, from colliding with the liquid application unit 26, and thus the timing when the liquid application head 27 is placed in a separated state is determined.

Figure 23A:
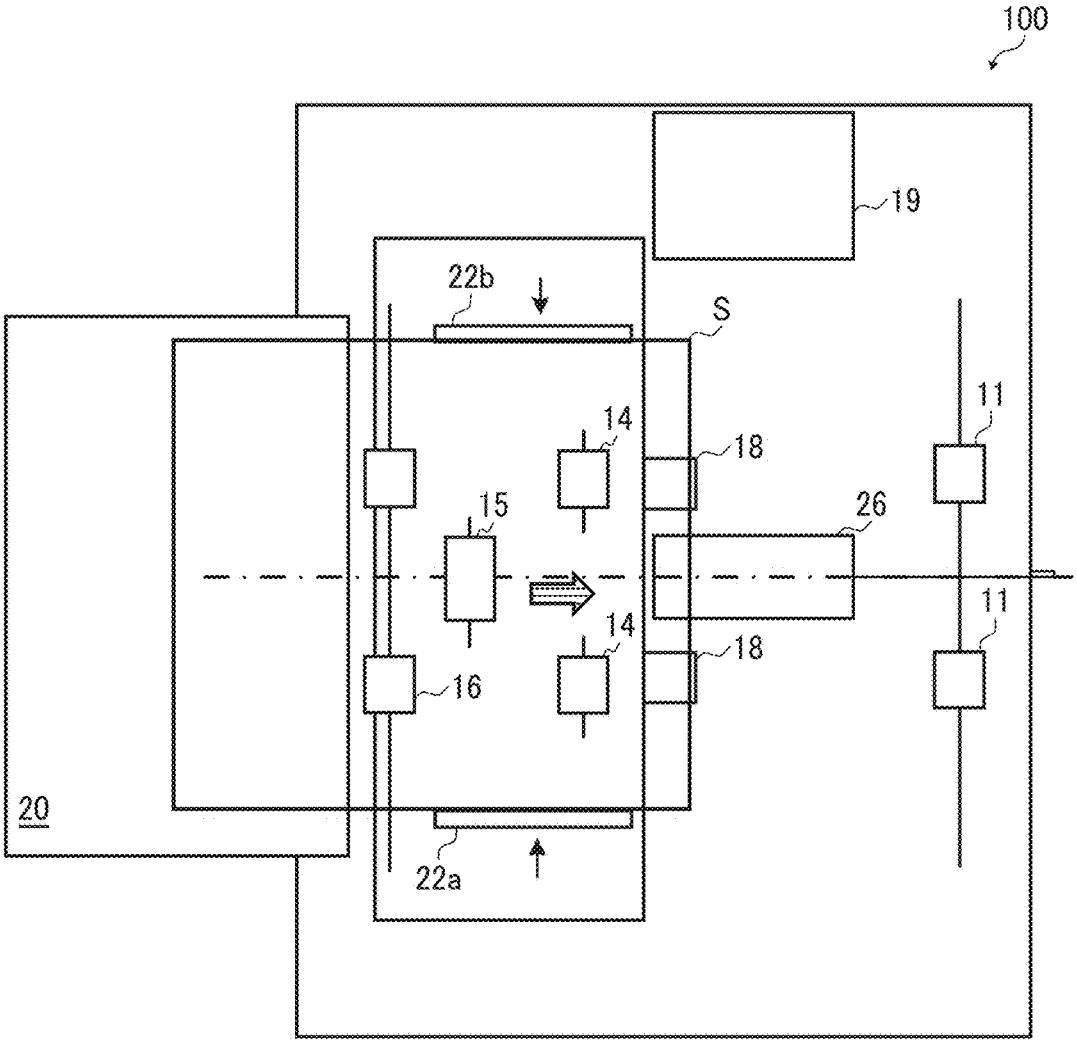
FIGS. 23A and 23B are diagrams illustrating an operation step of the binding process unit of FIG. 5.
Figure 23B:
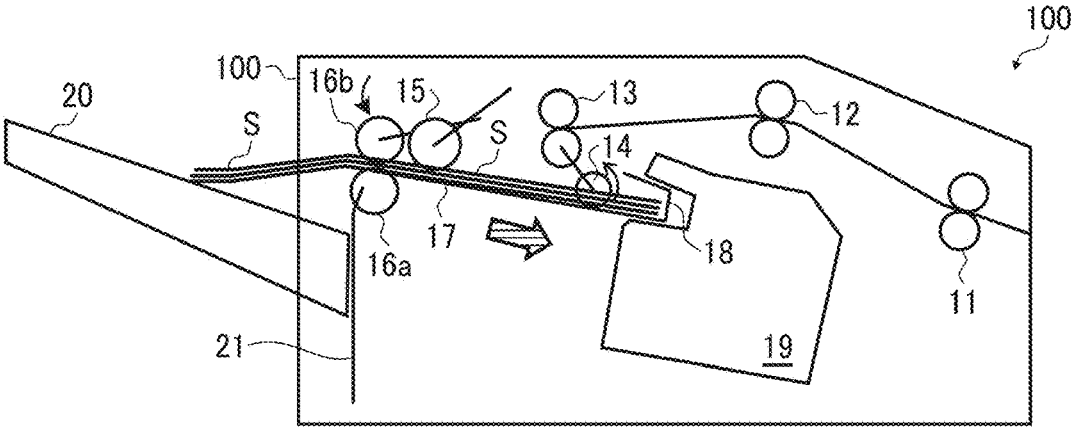

Subsequently, as illustrated in FIGS. 23A and 23B, the subsequent sheet Sr is switchback-conveyed until the subsequent sheet Sr abuts on the reference fence 18 under the action of the tapping roller 15 and the return roller 14. After the subsequent sheet Sr abuts on the reference fence 18, the jogger fence 22 is operated to align the end in the width direction of the sheet bundle Sb.

Figure 24:
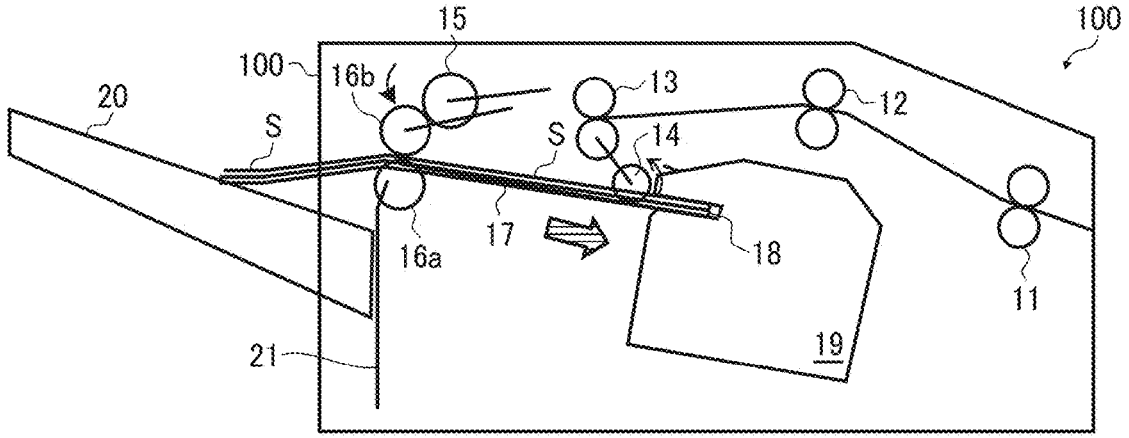
FIG. 24 is a diagram illustrating an operation step of the binding process unit of FIG. 5.

Subsequently, by repeating the operations of FIGS. 20 to 23, a sheet bundle Sb including a predetermined number of sheets can be formed. After the predetermined number of sheets are stacked and aligned, as illustrated in FIG. 24, the crimping unit 19 is moved toward the back of the binding process unit 100 (the back side in FIG. 24), and the liquid application unit 26 is moved to the binding position (see FIG. 16). That is, after the liquid application unit 26 is moved in the main scanning direction to a position corresponding to the binding position, the liquid application head 27 is driven to execute liquid application.

Thereafter, the liquid application unit 26 is moved to the front side (see FIG. 17 or 18), and the crimping unit 19 is moved to the binding position. That is, after the crimping unit 19 is moved in the main scanning direction, the crimp binding process is executed. In a case where the crimp binding process is to be executed, the ejection driven roller 16*b* is moved to the nip position, and the sheet bundle Sb is held so as not to be displaced by the crimp binding.

Figure 25:
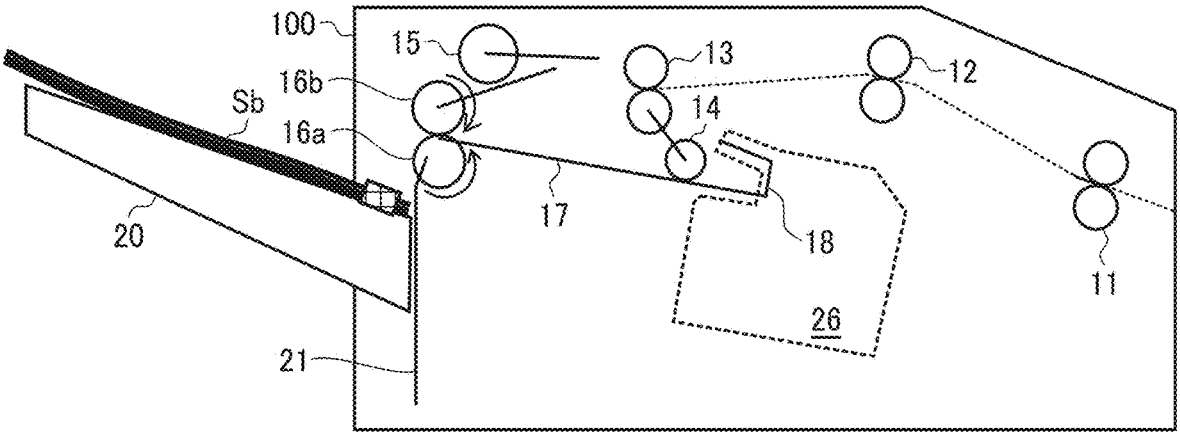
FIG. 25 is a diagram illustrating an operation step of the binding process unit of FIG. 5.

After the crimp binding process is completed, as illustrated in FIG. 25, the sheet bundle Sb is ejected onto the ejection tray 20 by the ejection roller 16.

Figure 26:
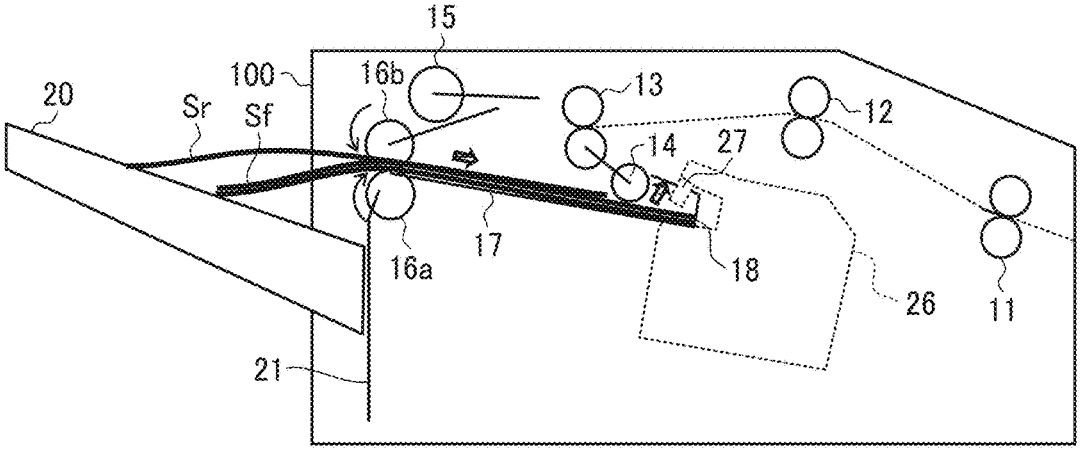
FIG. 26 is a diagram illustrating an operation step of the binding process unit of FIG. 5.
Figure 27:
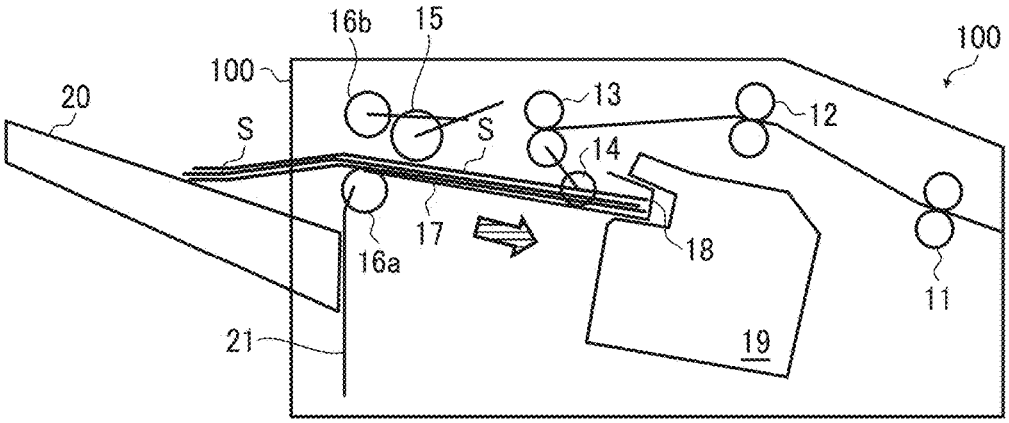
FIG. 27 is a diagram illustrating an operation step of the binding process unit of FIG. 5.
Figure 28:
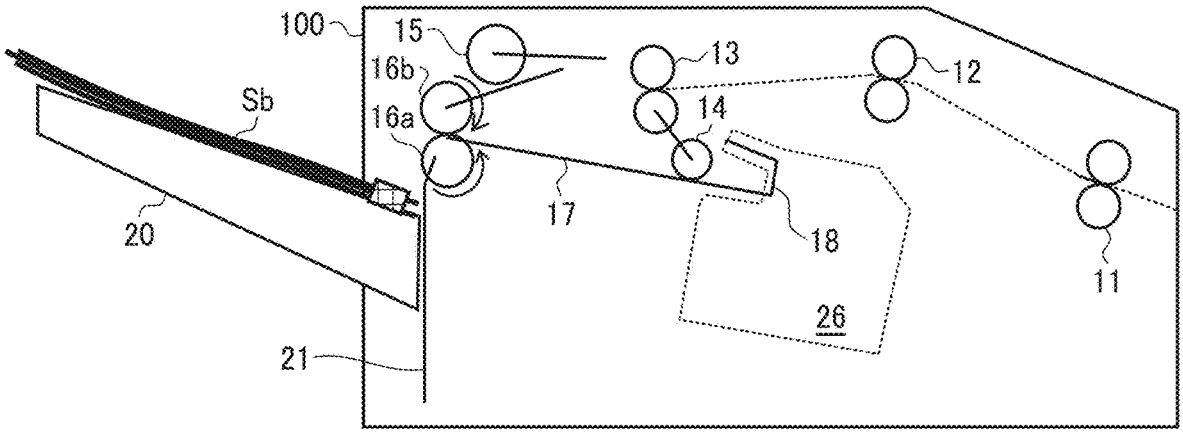
FIG. 28 is a diagram illustrating an operation step of the binding process unit of FIG. 5.

In the process step illustrated in FIG. 21, even in a case where the subsequent sheet Sr abuts on the preceding sheet Sf without the liquid application head 27 pressing the end of the sheet bundle Sb, and the preceding sheet Sf is displaced in the first direction due to the influence of friction, static electricity, or the like, the state illustrated in FIGS. 26 to 28 can be obtained.

That is, displacement of the preceding sheet Sf in the first direction is not eliminated, and the preceding sheet Sf is switchback-conveyed to the reference fence 18 together with the subsequent sheet Sr. Then, the crimp binding is executed in this state, and the sheet is conveyed to the ejection tray 20 (conveyed in the first direction).

As a result, as illustrated in FIG. 28, the sheet bundle Sb in which the ends in the conveyance direction are misaligned is ejected.

That is, with the binding process unit 100 according to the present embodiment, in a case where a plurality of sheets S is stacked to form the sheet bundle Sb, the liquid application unit 26 presses the end of the sheet S at a timing when the plurality of sheets S may be displaced in the conveyance direction due to friction or static electricity. Accordingly, misalignment of the sheet bundle Sb can be suppressed.

First Embodiment of Binding Process

Figure 29:
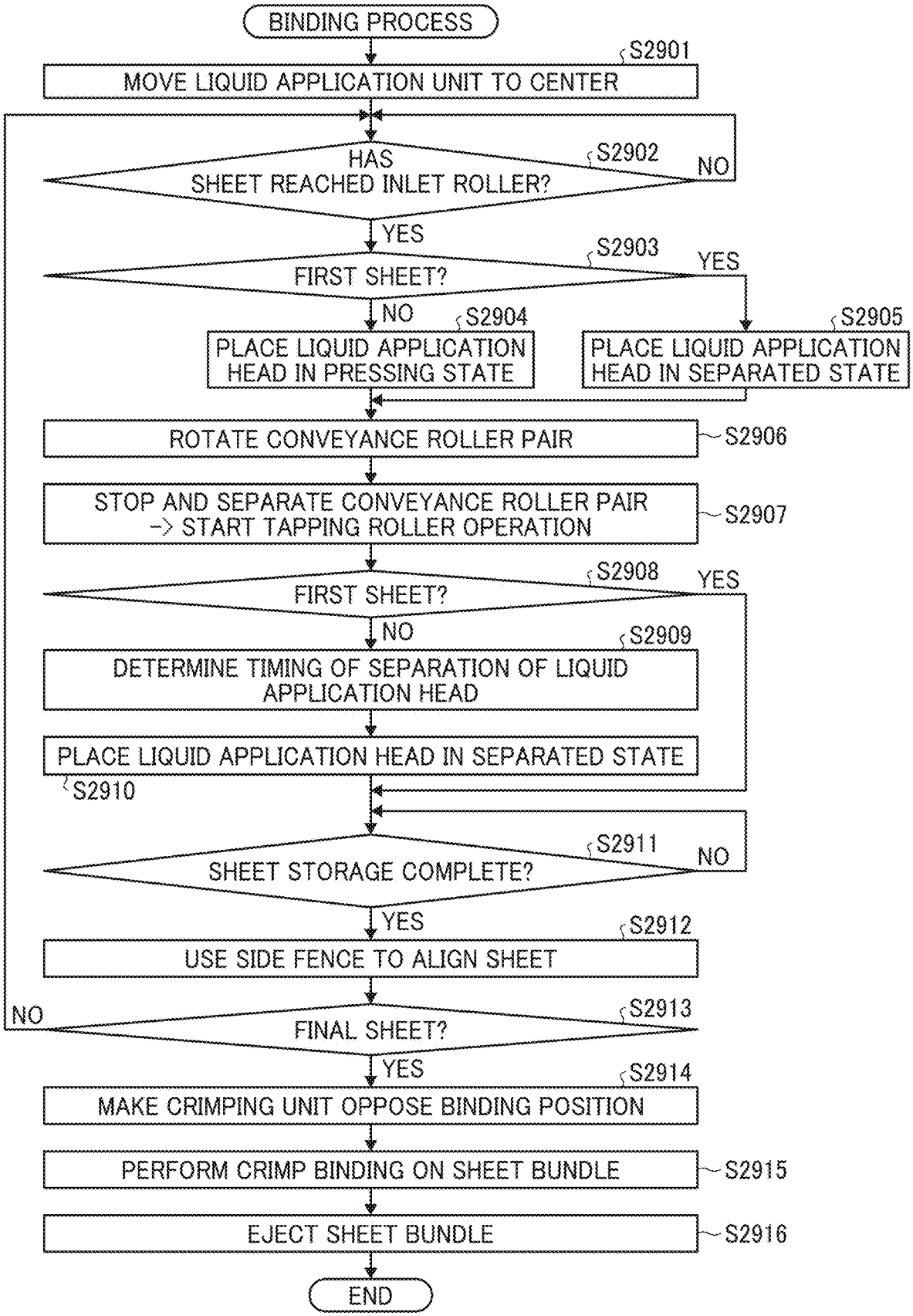
FIG. 29 is a flowchart of a binding process of a binding process unit.

Next, the binding process that can be executed in the binding process unit 100, which constitutes an embodiment of the sheet processing apparatus, will be described with reference to the flowchart in FIG. 29. The operations of FIGS. 20 to 28 described above are examples of operations that can be implemented by the processing illustrated in the flowchart of FIG. 29.

In response to an input of an image formation instruction via a predetermined user input interface, an image forming controller 306 causes the image former 32 to form an image on the sheet S, and outputs the sheet S on which the image has been formed to the binding process unit 100. More particularly, the image forming controller 306 causes the sheet S to be ejected until the sheet S reaches the inlet roller 11 of the binding process unit 100. The image formation instruction includes the number of sheets S on which an image is to be formed (hereinafter, referred to as the "predetermined number of sheets") and the binding position of the sheet bundle Sb. Therefore, the image forming controller 306 sequentially forms images on the predetermined number of sheets S.

In response to the input of the image formation instruction, the CPU 110 executes the binding process illustrated in FIG. 24 in parallel with the process of the image former 32 by the image forming controller 306. At the start of the binding process, the ejection driving roller 16*a* and the ejection driven roller 16*b* are separated from each other. It is assumed that the crimping unit 19 and the liquid application unit 26 are in an open state and are arranged in an initial position (home position).

The CPU 110 drives the liquid application unit movement motor 154, which serves as a liquid application mover, to move the liquid application unit 26 in the main scanning direction so as to be able to face a position including the center in the main scanning direction of the sheet S or the sheet bundle Sb stacked on the stacking tray 17 (S2901). The position of the movement destination of the liquid application unit 26 may not be substantially the center in the main scanning direction, and may be a position corresponding to the binding position to be pressure-deformed by the crimping unit 19 in the binding process of the subsequent stage.

The processing in step S2901 is executed before the first sheet S supplied from the image former 32 reaches the inlet roller 11. The CPU 110 waits for execution of the processing of step S2903 and subsequent steps until the leading end of the sheet S reaches the inlet roller 11 (S2902: No).

The CPU 110 can specify the position of the liquid application unit 26 in the main scanning direction by means of the liquid application unit position sensor 160 that detects the position of the liquid application unit 26, the rotary encoder of the liquid application unit movement motor 154, or a combination thereof.

Next, as illustrated in FIG. 10, in response to the arrival of the first sheet S at the inlet roller 11 (S2902: Yes & S2903: Yes), the CPU 110 maintains a separated state in which the liquid application head 27 of the liquid application unit 26 is separated from the sheet S instead of a pressing state in contact with the sheet S (S2905), and rotates the inlet roller 11, the conveyance roller 12, the shift roller 13, and the ejection roller 16 which serve as first conveyors (S2906). As a result, the sheet S is conveyed in the first direction as illustrated in FIG. 21.

If the sheet S that has reached the inlet roller 11 is not the first sheet (S2902: Yes & S2903: NO), the position of the liquid application head 27 of the liquid application unit 26 is set as a position (pressing position) in which the end of the sheet S or the sheet bundle Sb is brought into contact (S2904). At this time, the end of the sheet bundle Sb may be held down by being pressed by the liquid application head 27 to prevent displacement due to the influence of the subsequent sheet Sr, and at the same time, the liquid application may be performed in parallel. Hereinafter, the description will be continued assuming that the sheet S is not the first sheet (S2902: Yes & S2903: NO).

Subsequently, the inlet roller 11, the conveyance roller 12, the shift roller 13, and the ejection roller 16 serving as first conveyors and configured by a plurality of pairs of conveyance rollers are rotated to convey the sheet S (S2906). As a result, the sheet S is conveyed in the first direction as illustrated in FIG. 21.

Next, in response to the sheet S being placed on the stacking tray 17 (in other words, the rear end of the sheet S passes through the shift roller 13), the CPU 110 stops the operations of the inlet roller 11, the conveyance roller 12, the shift roller 13, and the ejection roller 16 serving as the first conveyors. Together with these stops, the tapping roller 15 is brought into contact with the sheet S and thus rotated (S2907). As a result, as illustrated in FIG. 22, the sheet S is conveyed (switchback-conveyed) in the second direction along the stacking tray 17.

Subsequently, it is determined again whether the sheet S placed (conveyed) on the stacking tray 17 does not correspond to the first sheet in the binding process currently being executed (S2908), and when the sheet S is the first sheet (S2908: Yes), the process moves to S2911. When the sheet S is not the first sheet (S2908: No), a determination process to determine whether or not the time corresponds to the timing to move the liquid application head 27 from the pressing state to the separated state is executed (S2909).

In S2909, at the timing when the liquid application head 27 is caused to transition to the separated state, the liquid application head 27 is caused to transition from the pressing state to the separated state (S2910), and the process moves to a stacking completion determination for the sheet S (subsequent sheet Sr) newly placed on the stacking tray 17 (S2911).

The period during which the liquid application head 27 presses the end of the sheet bundle Sb starts at the latest before the subsequent sheet Sr comes into contact with the preceding sheet Sf. Several variations can be assumed for the termination. One variation is before a predetermined time when the subsequent sheet Sr reaches the liquid application head 27. In this case, the shorter the predetermined time, the longer the period during which the liquid application head 27 presses the end of the sheet bundle Sb, and thus the effect of preventing displacement of the sheet bundle Sb is enhanced. The period may also extend until immediately before collision. The timing when the liquid application head 27 is transitioned from the pressing state to the separated state may be based on a timing that can be derived from a correlation between the number of drive pulses of the motor that drives the predetermined tapping roller 15 and the movement distance in the switchback conveying of the sheet S. The position of the subsequent sheet Sr may be defined in advance so as to be calculated on the basis of the number of drive pulses, and the timing when the number of drive pulses corresponds to the number of times the subsequent sheet Sr collides with the liquid application head 27 may be set as the timing for causing the liquid application head 27 to transition from the pressing position to the separation position.

Alternatively, the timing when the operation of the tapping roller 15 is started (S2907) and the timing when it is determined that the sheet S being switchback-conveyed is not the first sheet S with respect to the sheet bundle Sb (S2908: No) may be set as the timing when the liquid application head 27 transitions to the separated state.

Subsequently, as illustrated in FIG. 23B, the CPU 110 loops the processing until the rear end of the sheet S (subsequent sheet Sr) reaches the reference fence 18 (S2911: No).

The CPU 110 can specify the position of the sheet S by means of a sheet sensor that detects the sheet S in the binding process unit 100, a rotary encoder of a motor that rotates the inlet roller 11, the conveyance roller 12, the shift roller 13, the ejection roller 16, and the tapping roller 15, or a combination of the sheet sensor and the rotary encoder. Therefore, the timing determination in S2909 may be performed on the basis of the output of the sheet sensor.

Next, in response to the rear end of the sheet S reaching the reference fence 18 (S2911: Yes), the CPU 110 moves the jogger fence 22 in the main scanning direction, as illustrated in FIG. 23A. By this movement, the position in the main scanning direction of the sheet S stored in the stacking tray 17 is aligned (S2912).

Next, the CPU 110 determines whether a predetermined number of sheets S are stored in the stacking tray 17 (S2913). In a case where the CPU 110 determines that the predetermined number of sheets S are not stored in the stacking tray 17 (S2913: No), the CPU 110 executes the processing in step S2902 and subsequent steps on the next sheet S.

In a case where the CPU 110 determines that the predetermined number of sheets S are stored in the stacking tray 17 (S2913: Yes), the CPU 110 drives the binding unit movement motor 153 serving as a crimping unit mover as illustrated in FIG. 17. Due to this driving, the crimping unit 19 is moved to a position facing the binding position of the sheet bundle Sb stacked on the stacking tray 17 (S2914). Next, as illustrated in FIG. 24, the CPU 110 drives the crimping motor 156 to close the crimping unit 19, pressurizes and deforms a section of the end of the sheet bundle Sb, and executes crimp binding.

Next, as illustrated in FIG. 25, the CPU 110 causes the return roller 14 to come into contact with the sheet bundle Sb for which the binding process is complete, thereby rotating the sheet bundle Sb and thus causing same to enter between the ejection driving roller 16*a* and the ejection driven roller 16*b*. The CPU 110 causes the ejection driving roller 16*a* and the ejection driven roller 16*b* to hold the sheet bundle Sb. The CPU 110 also rotates the ejection roller 16 to eject the sheet bundle Sb to the ejection tray 20 (S2916).

There is known a post-process apparatus that has a liquid application function that applies liquid to a sheet to be stacked for the purpose of improving binding strength in a case where a binding process constituting one post-process is to be performed, and that improves the consistency of the sheets to which liquid is applied to prevent irregularities (see, for example, Patent Literature 1).

In the case of a so-called internal-ejection-type sheet processing apparatus in which a functional unit corresponding to the sheet processing apparatus is provided inside the housing of the image forming apparatus, the angle of the placement surface of the sheet tray may not be increased in order to align the sheet ends, and therefore improving the alignment accuracy of the sheet ends is problematic.

When a sheet to be newly placed is placed on a sheet already placed on the sheet tray, a sheet whose ends have already been aligned (a sheet placed previously) may be displaced due to friction or the like, and alignment accuracy may be reduced.

That is, in the prior art, a sheet processing apparatus tends to be large, and improving the end alignment accuracy when a plurality of sheets is stacked is problematic.

With the binding process unit 100 according to the present embodiment described above, in a case where the subsequent sheet Sr is conveyed in a state where the plurality of sheets S (sheet bundle Sb) is stacked on the stacking tray 17, it is possible to prevent misalignment of the sheet bundle Sb that occurs when the subsequent sheet Sr comes into contact with the preceding sheet Sf while being conveyed (while moving). That is, when friction or static electricity is generated between the preceding sheet Sf and the subsequent sheet Sr in a case where, while moving, the subsequent sheet Sr contacts the preceding sheet Sf already aligned, it is possible to prevent the already aligned preceding sheet Sf from being displaced in the movement direction of the subsequent sheet Sr. Accordingly, one of the features of the present embodiment is that the alignment accuracy of the sheet bundle Sb can be maintained.

In order to prevent the misalignment caused by the influence of a subsequent event on the sheet bundle Sb in the aligned state as described above, the liquid application head 27 presses the end of the sheet bundle Sb including the preceding sheet Sf before the subsequent sheet Sr comes into contact with the preceding sheet Sf (before S2906). Due to this pressing, the preceding sheet Sf the end of which is held down can obtain a resistance to an external force due to the contact of the subsequent sheet Sr, and thus displacement of the sheet bundle Sb can be prevented.

In a case where the shift ejection mode is used together with the crimp binding mode, when the subsequent sheet Sr is conveyed with respect to the preceding sheet Sf in S2906, the subsequent sheet Sr moves further in the main scanning direction while moving in the first direction relative to the preceding sheet Sf. Therefore, in preventing misalignment of the sheet bundle Sb, the binding process unit 100 according to the present embodiment can prevent displacement occurring in the first direction and displacement occurring in the main scanning direction.

Second Embodiment of Binding Process

Figure 30:
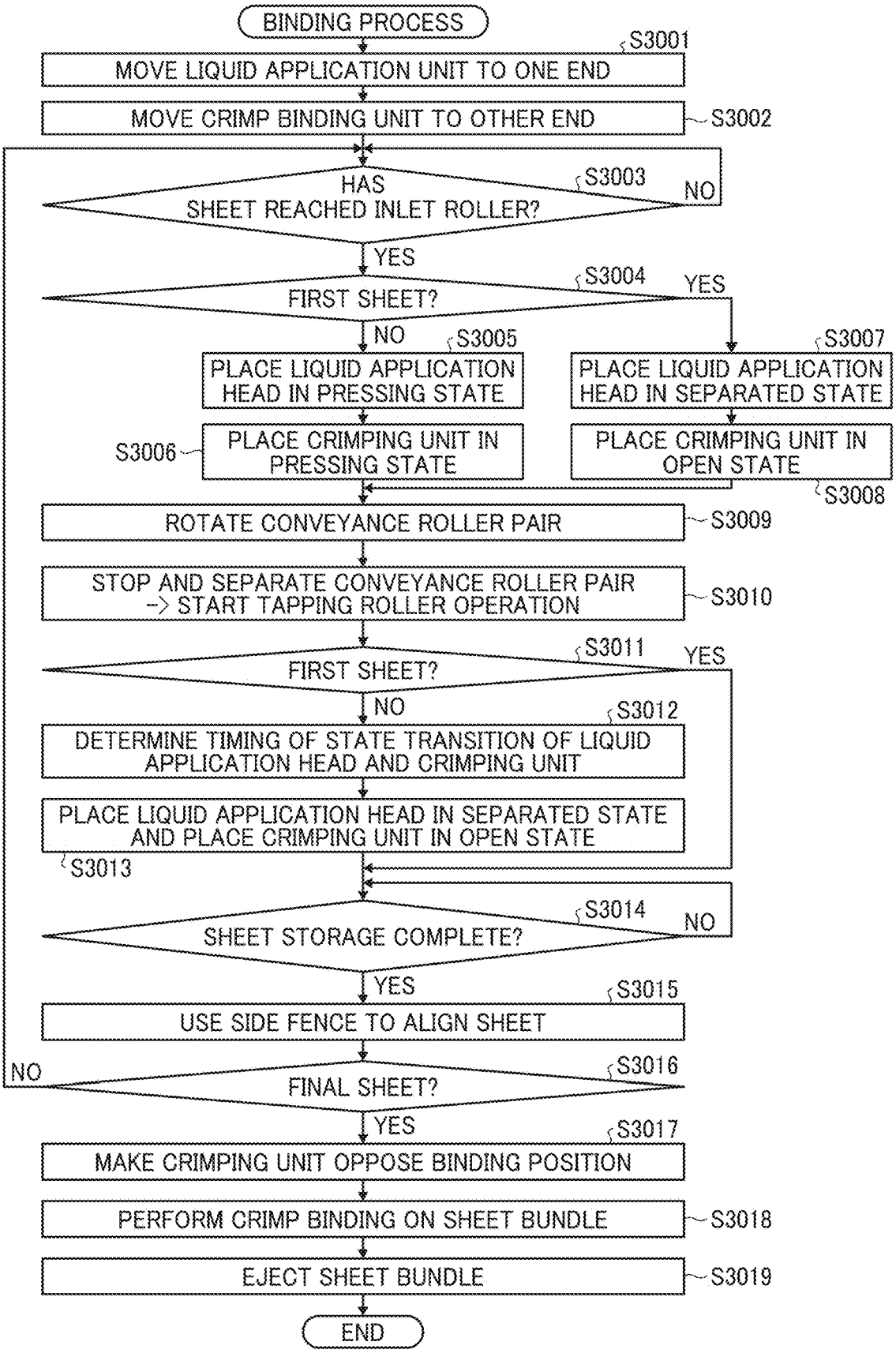
FIG. 30 is a flowchart of a binding process of a binding process unit.

Next, another binding process that can be executed in the binding process unit 100, which constitutes an embodiment of the sheet processing apparatus, will be described with reference to the flowchart of FIG. 30.

In response to an input of an image formation instruction via a predetermined user input interface, the CPU 110 causes the image former 32 to form an image on the sheet S, and outputs the sheet S on which the image has been formed to the binding process unit 100. More particularly, the CPU 110 ejects the sheet S until the sheet S reaches the inlet roller 11 of the binding process unit 100. The image formation instruction includes the number of sheets S on which an image is to be formed (hereinafter, referred to as the "predetermined number of sheets") and the binding position of the sheet bundle Sb. Therefore, the CPU 110 sequentially forms images on the predetermined number of sheets S.

In response to the input of the image formation instruction, the CPU 110 executes the binding process illustrated in FIG. 26 in parallel with the process of the image former 32. At the start of the binding process, the ejection driving roller 16*a* and the ejection driven roller 16*b* are separated from each other. It is assumed that the crimping unit 19 and the liquid application unit 26 are in an open state and are arranged in an initial position (home position).

The CPU 110 drives the liquid application unit movement motor 154, which serves as a liquid application mover, to move the liquid application unit 26 in the main scanning direction so as to be able to face the position of one end of the sheet S or the sheet bundle Sb stacked on the stacking tray 17 (S3001).

The CPU 110 drives the binding unit movement motor 153 to move the crimping unit 19 in the main scanning direction so as to be able to face the position of the other end of the sheet S or the sheet bundle Sb stacked on the stacking tray 17 (S3001).

Note that the positions of the movement destinations of the liquid application unit 26 and the crimping unit 19 may be other positions instead of the ends in the main scanning direction. For example, as long as the position does not interfere with the crimping unit 19, the liquid application unit 26 may be located in a position corresponding to the binding position in which the crimping unit 19 performs pressure deformation in the binding process of the subsequent stage.

The processing of steps S3001 and S3002 is executed before the first sheet S supplied from the image former 32 reaches the inlet roller 11. The CPU 110 then awaits execution of the processing in step S3004 and subsequent steps until the leading end of the sheet S reaches the inlet roller 11 (S3003: No).

The CPU 110 can specify the positions of the crimping unit 19 and the liquid application unit 26 in the main scanning direction by means of the liquid application unit position sensor 160 that detects the position of the liquid application unit 26, the rotary encoder of the liquid application unit movement motor 154, or a combination of the position sensor and the rotary encoder.

Next, in response to the arrival of the first sheet S at the inlet roller 11 (S3003: Yes & S3004: Yes), the CPU 110 maintains the separated position separated from the sheet S instead of the pressing state in which the liquid application head 27 of the liquid application unit 26 is in contact with the sheet S (S3007). The crimping unit 19 brings the binding teeth into an open state (open state) instead of a pressing state in which the sheet S is not pressurized and deformed (S3008).

Subsequently, the inlet roller 11, the conveyance roller 12, the shift roller 13, and the ejection roller 16 serving as first conveyors are rotated (S3009). As a result, the sheet S is conveyed in the first direction.

When the sheet S that has reached the inlet roller 11 is not the first sheet (S3003: Yes & S3004: NO), the liquid application head 27 of the liquid application unit 26 is brought into contact with the end of the sheet S or the sheet bundle Sb (pressing state) (S3005). At this time, the end of the sheet bundle Sb may be held down by being pressed by the liquid application head 27 to prevent displacement due to the influence of the subsequent sheet Sr, and at the same time, the liquid application may be performed in parallel.

The binding teeth of the crimping unit 19 are closed to bring the end of the sheet bundle Sb into a state of being pressed (a pressing state) to the extent that same is not pressure-deformed (S3006). Hereinafter, the description will be continued assuming that the sheet S is not the first sheet (S3003: Yes & S3004: NO).

Subsequently, the inlet roller 11, the conveyance roller 12, the shift roller 13, and the ejection roller 16 serving as the first conveyors and configured by a plurality of pairs of conveyance rollers are rotated to convey the sheet S (S3009). As a result, the sheet S is conveyed in the first direction.

Next, in response to the sheet S being placed on the stacking tray 17 (in other words, the rear end of the sheet S passes through the shift roller 13), the CPU 110 stops the operations of the inlet roller 11, the conveyance roller 12, the shift roller 13, and the ejection roller 16 serving as first conveyors. Together with these stops, the tapping roller 15 is brought into contact with the sheet S and thus rotated (S3010). As a result, the sheet S is conveyed (switchback-conveyed) in the second direction along the stacking tray 17.

Subsequently, it is determined again whether the sheet S placed (conveyed) onto the stacking tray 17 does not correspond to the first sheet in the binding process currently being executed (S3011), and when the sheet S is the first sheet (S3011: No), the processing is moved to step S3014. If the sheet S is not the first sheet (S3011: Yes), a determination process is executed to determine whether the time corresponds to the timing when the liquid application head 27 and the crimping unit 19 are to be transitioned from the pressing state to the separated state or the open state (S3012).

In step S3012, if the timing when the liquid application head 27 is to be transitioned to the separated state and the timing when the crimping unit 19 is to be opened have been reached, the liquid application head 27 is transitioned from the pressing state to the separated state and the crimping unit 19 is transitioned from the pressing state to the open state (S3013), and the processing moves to determine stacking completion of the sheet S (subsequent sheet Sr) newly placed on the stacking tray 17 (S3014).

The period during which the liquid application head 27 and the crimping unit 19 press the end of the sheet bundle Sb is before the subsequent sheet Sr comes into contact with the preceding sheet Sf, and at the latest, the point at which the switchback conveying of the subsequent sheet Sr starts is set as the starting point. Several variations can be assumed for the end of the period in which the liquid application head 27 and the crimping unit 19 press the end of the sheet bundle Sb. One variation may be immediately before the subsequent sheet Sr collides with the liquid application head 27 and the crimping unit 19. The timing when the liquid application head 27 is to be transitioned from the pressing state to the separated state and the timing when the crimping unit 19 is to be transitioned from the pressing state to the open state may be based on the correlation between the number of drive pulses of the motor that drives the predetermined tapping roller 15 and the movement distance in the switchback conveying of the sheet S. The position of the subsequent sheet Sr is defined in advance so that same can be calculated on the basis of the number of drive pulses, and the time when the number of drive pulses reaches the number of times the subsequent sheet Sr collides with the liquid application head 27 may be set as the timing when the liquid application head 27 is to be transitioned from the pressing state to the separated state and the crimping unit 19 is to be transitioned from the pressing state to the open state.

Alternatively, the operation of the tapping roller is started (S3010), and the timing when it is determined that the sheet S performing the switchback conveying is not the first sheet S with respect to the sheet bundle Sb (S3011: Yes) may be set as the timing when the liquid application head 27 is to be transitioned to the separated state and the timing when the crimping unit 19 is to be placed in an open state.

Subsequently, the CPU 110 loops the processing until the rear end of the sheet S (subsequent sheet Sr) reaches the reference fence 18 (S3014: No).

The CPU 110 can specify the position of the sheet S by means of a sheet sensor that detects the sheet S in the binding process unit 100, a rotary encoder of a motor that rotates the inlet roller 11, the conveyance roller 12, the shift roller 13, the ejection roller 16, and the tapping roller 15, or a combination of the sheet sensor and the rotary encoder. Therefore, the timing determination in S3012 may be performed on the basis of the output of the sheet sensor.

Next, in response to the rear end of the sheet S reaching the reference fence 18 (S3014: Yes), the CPU 110 moves the jogger fence 22 in the main scanning direction to align the position of the sheet S stored in the stacking tray 17 in the main scanning direction (S3015).

Next, the CPU 110 determines whether a predetermined number of sheets S are stored in the stacking tray 17 (S3016). In a case where the CPU 110 determines that the predetermined number of sheets S are not stored in the stacking tray 17 (S3016: No), the CPU 110 executes the processing in step S3003 and subsequent steps on the next sheet S.

In a case where the CPU 110 determines that the predetermined number of sheets S are stored in the stacking tray 17 (S3016: Yes), the CPU 110 drives the binding unit movement motor 153 serving as the crimping unit mover to move the crimping unit 19 to a position facing the binding position of the sheet bundle Sb stacked on the stacking tray 17 (S3017). Next, the CPU 110 drives the crimping motor 156 to close the crimping unit 19, pressurizes and deforms a portion of the end of the sheet bundle Sb, and executes crimp binding (S3018).

Next, the CPU 110 brings the return roller 14 into contact with the sheet bundle Sb for which the binding process is complete, thereby rotating the sheet bundle Sb and thus causing same to enter between the ejection driving roller 16*a* and the ejection driven roller 16*b*. The CPU 110 causes the ejection driving roller 16*a* and the ejection driven roller 16*b* to hold the sheet bundle Sb. The CPU 110 also rotates the ejection roller 16 to eject the sheet bundle Sb to the ejection tray 20 (S3019).

With the binding process unit 100 according to the present embodiment described above, when the subsequent sheet Sr is conveyed in a state where the plurality of sheets S (sheet bundle Sb) is stacked on the stacking tray 17, it is possible to prevent misalignment caused by the subsequent sheet Sr coming into contact with the preceding sheet Sf while being conveyed (moving). That is, while moving, the subsequent sheet Sr comes into contact with the preceding sheet Sf that has already been aligned, thereby preventing the preceding sheet Sf from being displaced from a state of alignment, due to friction with the subsequent sheet Sr or static electricity, in the movement direction of the subsequent sheet Sr. Accordingly, one of the features of the present embodiment is that the alignment accuracy of the sheet bundle Sb can be maintained.

In order to prevent the misalignment of the sheet bundle Sb in the aligned state due to the influence of a subsequent event, the liquid application head 27 and the crimping unit 19 press the end of the sheet bundle Sb including the preceding sheet Sf before the subsequent sheet Sr comes into contact with the preceding sheet Sf (before S3009). Due to this pressing, the preceding sheet Sf the end of which is held down can obtain a resistance to an external force due to the contact of the subsequent sheet Sr, and thus displacement of the sheet bundle Sb can be prevented.

In a case where the shift ejection mode is used together with the crimp binding mode, when the subsequent sheet Sr is conveyed with respect to the preceding sheet Sf in S3009, the subsequent sheet Sr moves further in the main scanning direction while moving in the first direction relative to the preceding sheet Sf. Therefore, in preventing misalignment of the sheet bundle Sb, the binding process unit 100 according to the present embodiment can prevent displacement occurring in the first direction and displacement occurring in the main scanning direction.

As described above, the pressing of the end of the sheet bundle Sb may be performed only by the liquid application unit 26, but is not limited thereto. For example, the binding teeth (crimping portion) of the crimping unit 19 may be used instead of the liquid application head 27 to press the end with a strength sufficient to prevent the movement of the end without crimping the end. The end of the sheet bundle Sb may be pressed using both the liquid application unit 26 and the crimping unit 19.

That is, the CPU 110, which serves as a controller according to the present embodiment, operates the liquid application unit 26 and the crimping unit 19 as an end presser for suppressing misalignment of the end of the sheet bundle Sb.

With the binding process unit 100 according to the present embodiment described above, in a case where the plurality of sheets S is stacked to form the sheet bundle Sb, the end of the sheet S can be pressed by the end presser according to the timing when the already stacked and aligned sheet (preceding sheet Sf) is misaligned due to friction or static electricity by conveying the newly stacked sheet S (subsequent sheet Sr), and thus misalignment can be suppressed. The binding process unit 100 according to the present embodiment may operate only the liquid application unit 26 as the end presser, or may operate only the crimping unit 19 as the end presser. Alternatively, both the liquid application unit 26 and the crimping unit 19 may be used and made to operate as end pressers.

Embodiment of Liquid Application Unit 26

Figure 31:
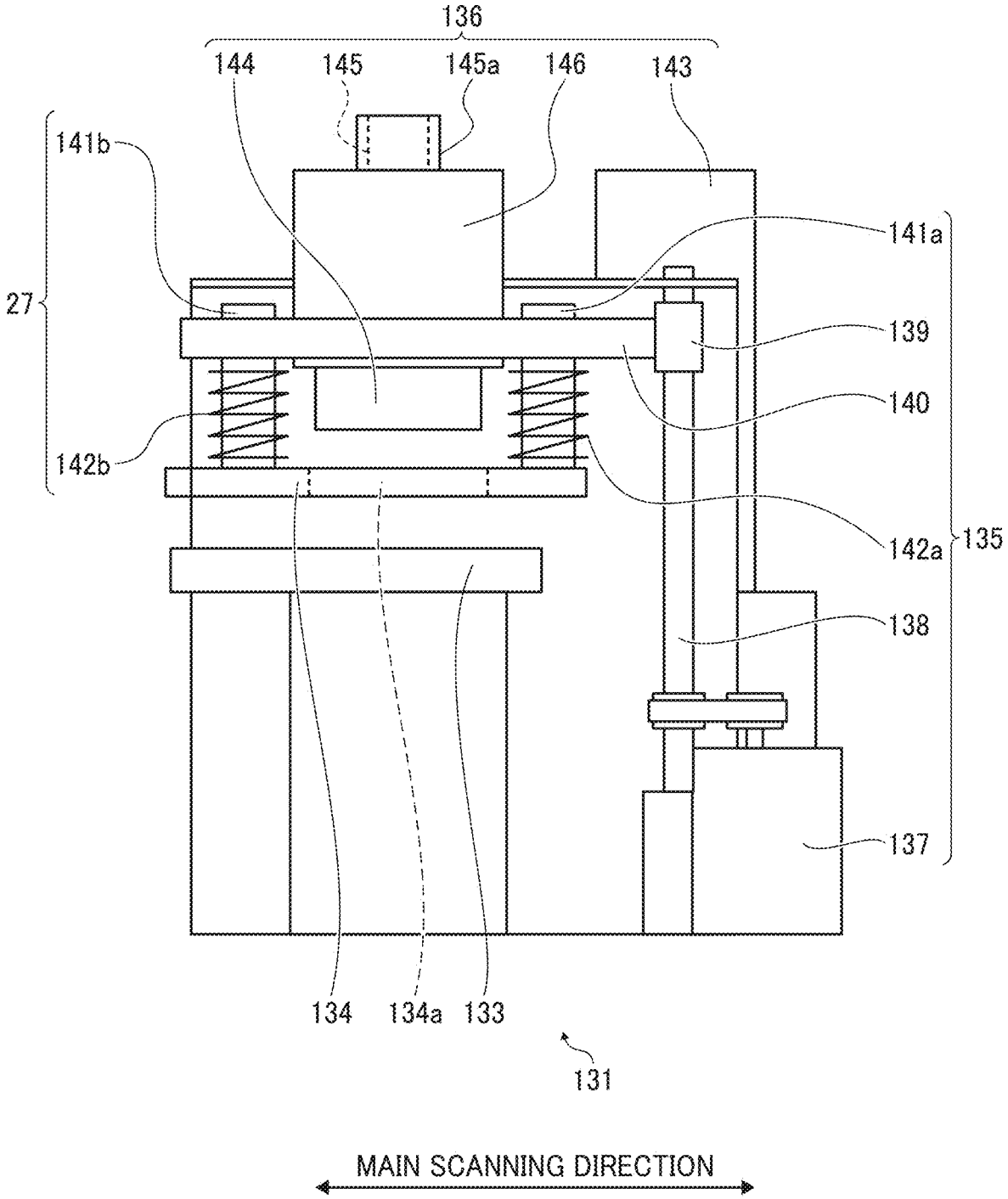
FIG. 31 is a diagram illustrating a configuration of a liquid application unit viewed from upstream in a conveyance direction.
Figure 32:
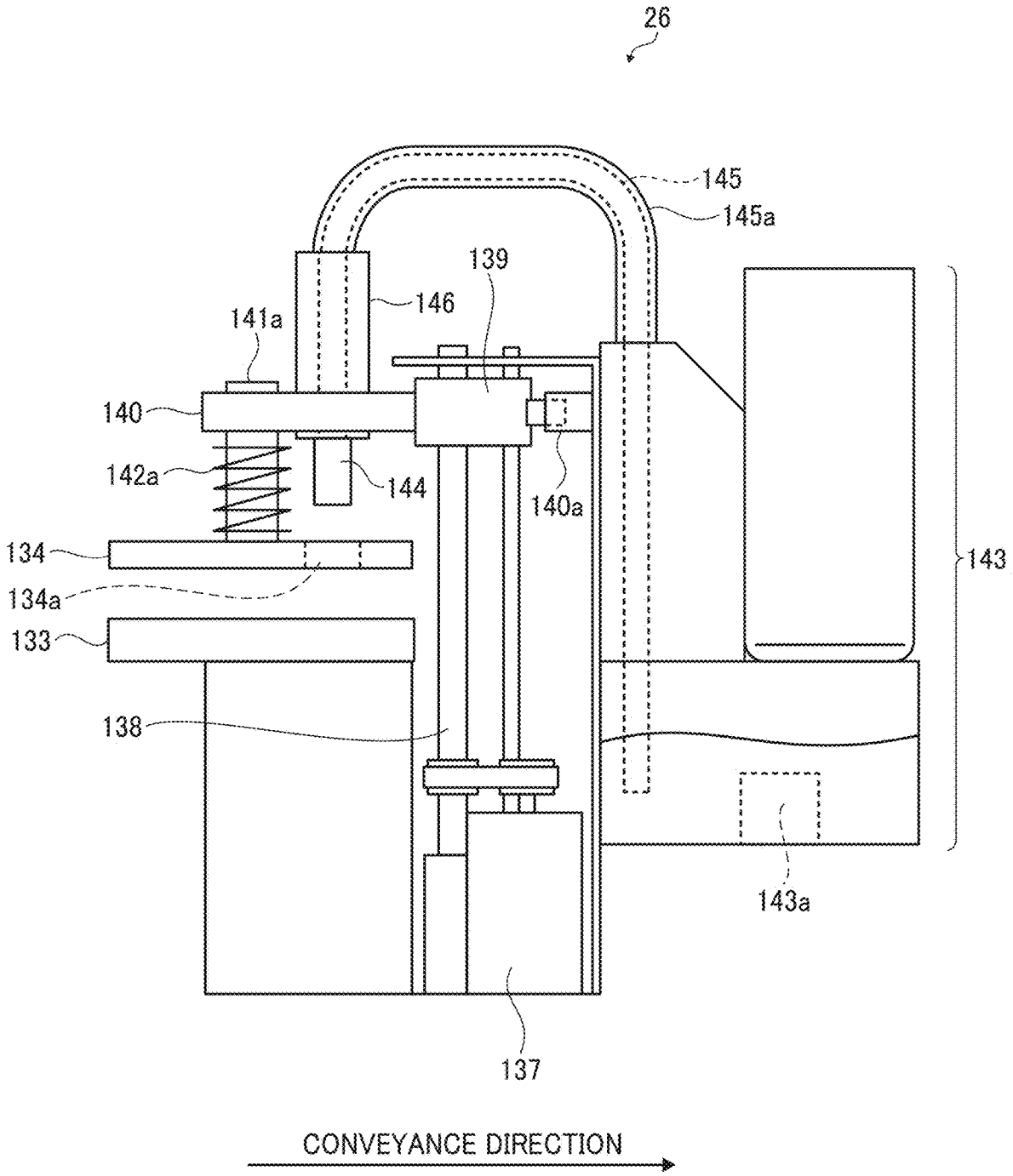
FIG. 32 is a diagram illustrating a configuration of the liquid application unit of FIG. 31 viewed from a main scanning direction.

Next, details of the liquid application unit 26 will be described. FIG. 31 is a schematic view of the inside of the liquid application unit 26 as viewed from upstream in the conveyance direction. FIG. 32 is a schematic view of the inside of the liquid application unit 26 as viewed from the main scanning direction side.

The liquid application unit 26 applies (hereinafter referred to as "liquid application") the liquid (for example, water) stored in a liquid storage tank 143 to the sheet S supported on the stacking tray 17. The liquid application unit 26 is movable in the main scanning direction by the transmission of a driving force of a liquid application motor 155 (see FIG. 4).

As illustrated in FIGS. 31 and 32, the liquid application unit 26 mainly includes a lower pressing plate 133, an upper pressing plate 134 (pressing part), a lifting/lowering mechanism 135, and a liquid application mechanism 136. A part obtained by excluding the lower pressing plate 133 from the foregoing combination of plates and mechanisms is referred to as the liquid application head 27.

The lower pressing plate 133 and the upper pressing plate 134 are arranged downstream from the stacking tray 17 in the conveyance direction. The lower pressing plate 133 supports the sheet bundle Sb supported on the stacking tray 17 from below. The upper pressing plate 134 is capable of moving up and down above the sheet bundle Sb supported by the stacking tray 17. That is, the lower pressing plate 133 and the upper pressing plate 134 are arranged to face each other in the thickness direction of the sheet bundle Sb (hereinafter, simply referred to as the "thickness direction") with the sheet bundle Sb supported by the stacking tray 17 interposed therebetween. A through-hole 134*a* penetrating in the thickness direction is formed in the upper pressing plate 134 in a position facing the leading end of the liquid application member 144 supported by the base plate 140.

The lifting/lowering mechanism 135 lifts and lowers the upper pressing plate 134, the base plate 140 (base member), and the liquid application member 144 in the thickness direction of the sheet bundle Sb. The lifting/lowering mechanism 135 according to the present embodiment lifts and lowers the upper pressing plate 134, the base plate 140, and the liquid application member 144 in conjunction with one another by means of a single lifting/lowering motor 137 (drive source). The lifting/lowering mechanism 135 mainly includes, for example, a lifting/lowering motor 137, a trapezoidal screw 138, a nut 139, a base plate 140, columnar members 141*a* and 141*b*, and coil springs 142*a* and 142*b* (biasing members).

The lifting/lowering motor 137 generates a driving force to lift and lower the upper pressing plate 134, the base plate 140, and the liquid application member 144. The trapezoidal screw 138 extends in the vertical direction. The trapezoidal screw 138 is connected to an output shaft of the lifting/lowering motor 137 via a pulley, a belt, or the like. The nut 139 is screwed to the trapezoidal screw 138. The driving force of the lifting/lowering motor 137 is transmitted to rotate the trapezoidal screw 138, thereby lifting and lowering the nut 139.

The base plate 140 is a flat plate parallel to the sheet bundle Sb supported by the stacking tray 17. The base plate 140 is disposed above the upper pressing plate 134. The base plate 140 supports the liquid application member 144 in a state where the leading end of the liquid application member 144 protrudes downward. The base plate 140 is also connected to the trapezoidal screw 138 so as to be movable up and down together with the trapezoidal screw 138. The vertical position of the base plate 140 is detected by the lifting/lowering sensor 140*a*.

The columnar members 141*a* and 141*b* project downward from the base plate 140 around the leading end of the liquid application member 144. The columnar members 141*a* and 141*b* are movable relative to the base plate 140 in the thickness direction. The columnar members 141*a* and 141*b* support, at the lower ends thereof, the upper pressing plate 134. The coil springs 142*a* and 142*b* are fitted around the columnar members 141*a* and 141*b*, respectively, between the base plate 140 and the upper pressing plate 134. The coil springs 142*a* and 142*b* bias the upper pressing plate 134 and the columnar members 141*a* and 141*b* downward with respect to the base plate 140.

The liquid application mechanism 136 applies liquid to the sheet bundle Sb supported by the stacking tray 17 serving as the internal tray. More particularly, the liquid application mechanism 136 applies the liquid to at least one sheet S constituting the sheet bundle Sb by bringing the leading end of the liquid application member 144 into contact with the sheet bundle Sb. The liquid application mechanism 136 mainly includes a liquid storage tank 143, a liquid application member 144, a supply member 145, and a joint 146.

Figure 33:
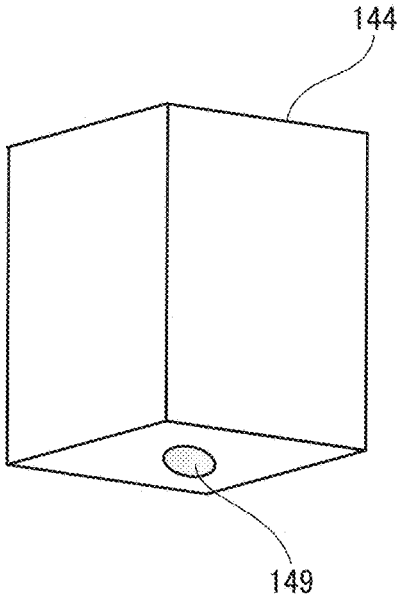
FIG. 33 is a perspective view of a liquid application head included in the liquid application unit of FIG. 31.

FIG. 33 is a diagram of the liquid application member 144 as viewed obliquely from below. A configuration in which the spray port 149 is provided on the lower surface of the liquid application member 144 is illustrated.

The liquid storage tank 143 stores water to be supplied to the sheet bundle Sb. The amount of water stored in the liquid storage tank 143 is detected by the water amount sensor 143*a*. The liquid application member 144 sprays the liquid (for example, "water") stored in the liquid storage tank 143 onto the sheet bundle Sb. The liquid application member 144 is supported by the base plate 140 with the leading end of the liquid application member facing downward. By spraying the liquid, a small amount of liquid can be applied over a wide range.

The supply member 145 is a long member having a proximal end immersed in water stored in the liquid storage tank 143 and a leading end connected to the liquid application member 144. The supply member 145 is made of a material having a high water absorption rate. Accordingly, water absorbed from the base end of the supply member 145 is supplied to the liquid application member 144 by capillary action. A protector 145*a* is an elongated cylindrical body (for example, a tube) that is fitted around a supply member 145. As a result, it is possible to prevent the water absorbed by the supply member 145 from leaking out or evaporating.

The supply member 145 and the protector 145*a* are each made of a flexible material. The joint 146 fixes the liquid application member 144 to the base plate 140. As a result, even when the liquid application member 144 is lifted or lowered by the lifting/lowering mechanism 135, the liquid application member protrudes downward from the base plate 140 and maintains a state in which the leading end faces downward.

End Pressing Operation by Liquid Application Unit 26

Next, an operation in which the end of the sheet bundle Sb is pressed by the liquid application unit 26 will be described in detail with reference to FIGS. 34 to 36.

Figure 34:
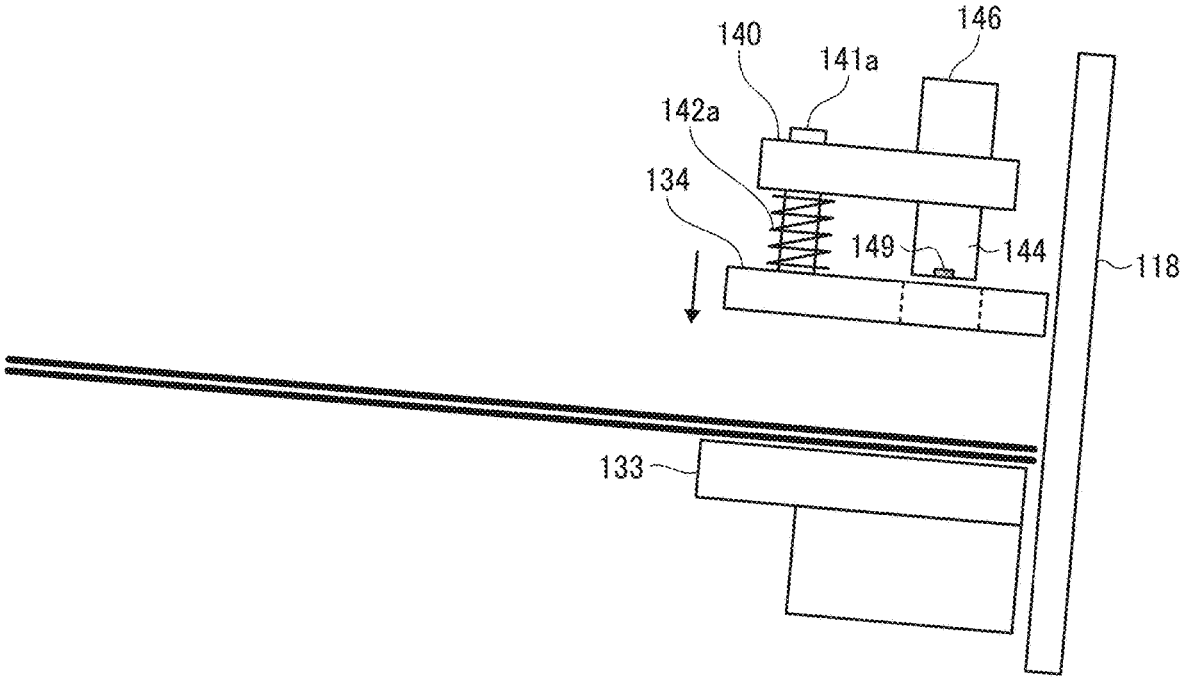
FIG. 34 is a diagram illustrating an operation step of a binding process unit.

FIG. 34 illustrates a state before the end of the sheet bundle Sb is pressed by the liquid application unit 26. That is, in FIG. 34, the upper pressing plate 134 is not in contact with the sheet bundle Sb.

Figure 35:
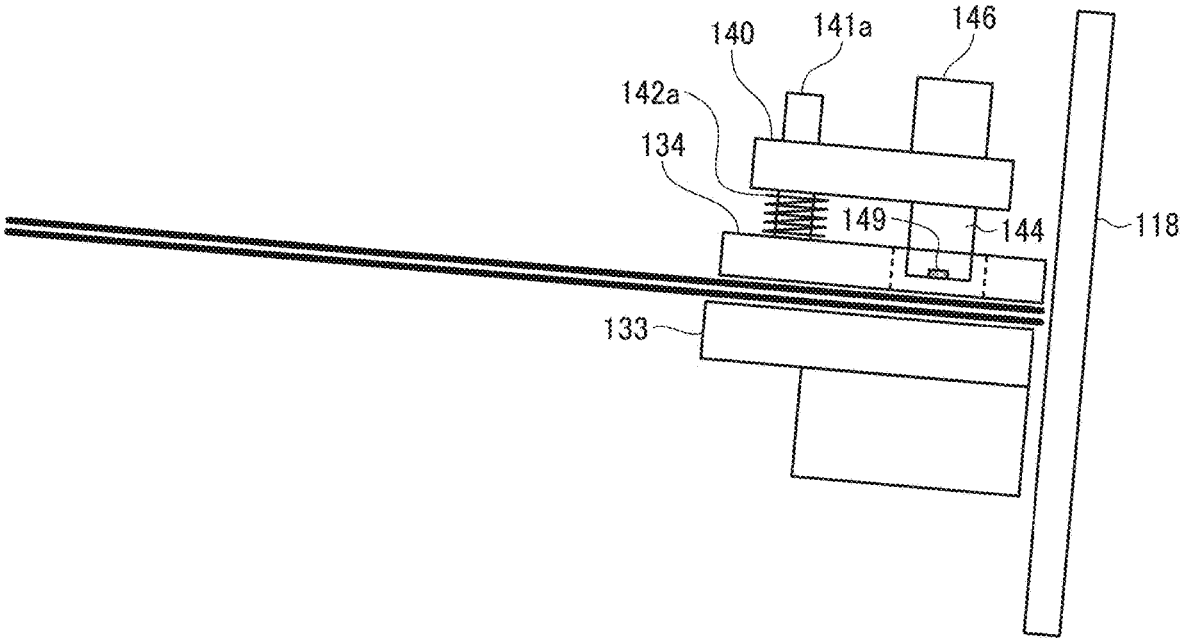
FIG. 35 is a diagram illustrating an operation step of the binding process unit of FIG. 34.

FIG. 35 illustrates a state in which the end of the sheet bundle Sb is pressed by the liquid application unit 26. That is, in FIG. 35, the upper pressing plate 134 is in contact with and presses the sheet bundle Sb. Meanwhile, the liquid application member 144 and the spray port 149 perform the holding operation without being in contact with the sheet S, and thus the amount of liquid applied at the time of the holding can be reduced, or pressing can be performed without applying liquid at all. That is, a series of configurations that control the operation so as to bring only the upper pressing plate 134 into contact with the sheet S without bringing the liquid application member 144 into contact with the sheet S corresponds to a liquid amount adjuster. It is thus possible to suppress a decrease in the amount of liquid.

Figure 36:
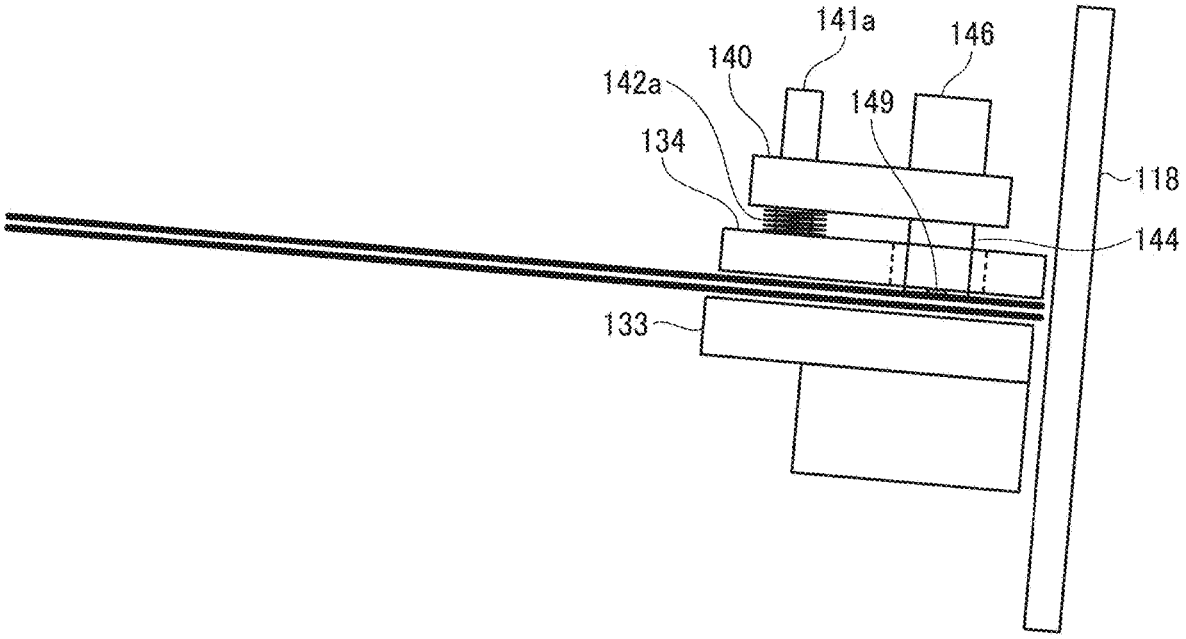
FIG. 36 is a diagram illustrating an operation step of the binding process unit of FIG. 34.

FIG. 36 illustrates a state in which the liquid application unit 26 simultaneously applies the liquid while pressing the sheet bundle Sb. In FIG. 36, liquid application is performed by bringing the liquid application member 144 and the spray port 149 into contact with the sheet S (into a pressing state), and spraying liquid from the spray port 149.

According to the embodiment described above, when the plurality of sheets S is stacked to form the sheet bundle Sb, the liquid application unit 26 used for sheet processing can be used as a member serving to prevent disturbance of the alignment of the end of the sheets S due to the influence of friction or static electricity between the sheets. Accordingly, it is not necessary to separately provide a member for holding down the sheet bundle, and the number of parts can be reduced.

Because the ends of the sheets S can be aligned using a drive mechanism such as a roller, it is not necessary to increase the inclination angle of the stacking tray 17. That is, the above-described embodiment can be miniaturized and is also applicable to an internal type unit.

The present invention is not limited to the above-described embodiments, rather, numerous modifications are possible within the technical scope of the present invention, and all technical features included in the technical concepts set forth in the claims are the subject of the present invention. While the above-described embodiments are preferred examples, those skilled in the art will be able to conceive of various modifications from the content disclosed herein. Such modifications and variations are included in the technical scope as set forth in the claims.

Aspects of the present disclosure are, for example, as follows.

First Aspect

A sheet processing apparatus includes: an ejection tray to stack a plurality of sheet media; an internal tray to stack the sheet media at a position different from the ejection tray; a first conveyor to convey a sheet medium in a first direction in which the sheet medium is ejected to the ejection tray; a second conveyor to come into contact with and separate from the sheet media stacked on the internal tray to convey the sheet media in a second direction different from the first direction; a crimp binder disposed downstream from the internal tray in the second direction to execute crimp binding on the sheet media stacked on the internal tray; and a controller to control operations of the first conveyor, the second conveyor, and the crimp binder. When a subsequent sheet medium, which is subsequent to a preceding sheet medium of the sheet media stacked on the internal tray, is conveyed in the first direction while contacting the preceding sheet medium, the controller causes the crimp binder to press a downstream end of the preceding sheet medium in the second direction.

Second Aspect

A sheet processing apparatus includes: an ejection tray to stack a plurality of sheet media; an internal tray to stack the sheet media in a different position from the ejection tray; a first conveyor to convey a sheet medium in a first direction in which the sheet medium is ejected to the ejection tray; a second conveyor to come into contact with and separate from the sheet media stacked on the internal tray to convey the sheet media in a second direction different from the first direction; a liquid applier disposed downstream from the internal tray in the second direction to perform liquid application to the sheet media stacked on the internal tray; a crimp binder disposed downstream from the internal tray in the second direction to execute crimp binding on the sheet media stacked on the internal tray; and a controller configured to control operations of the first conveyor, the second conveyor, the liquid applier, and the crimp binder. When a subsequent sheet medium, which is subsequent to a preceding sheet medium of the sheet media stacked on the internal tray, is conveyed in the first direction while contacting the preceding sheet medium, the controller causes the liquid applier or the crimp binder to press a downstream end of the preceding sheet medium in the second direction.

Third Aspect

In the sheet processing apparatus according to the second aspect, the controller causes the crimp binder and the liquid applier to press the downstream end of the preceding sheet medium in the second direction.

Fourth Aspect

In the sheet processing apparatus according to the second aspect, when the subsequent sheet medium is being conveyed in the second direction, the controller causes the liquid applier or the crimp binder to release pressing on the downstream end.

Fifth Aspect

The sheet processing apparatus according to any one of the second to fourth aspects, further includes: a media detector to detect a position of a sheet medium being conveyed; and a reference fence on which an end of the subsequent sheet medium abuts when the subsequent sheet medium is stacked on the preceding sheet medium. When the subsequent sheet medium is conveyed in the second direction, the controller causes the liquid applier or the crimp binder to release pressing on the downstream end.

Sixth Aspect

The sheet processing apparatus according to any one of the second to fifth aspects, further includes a media shifter to move a position of a sheet medium in a main scanning direction. When the media shifter moves the position of the sheet medium in the main scanning direction without execution of the crimp binding, the controller causes the liquid applier or the crimp binder to press the downstream end.

Seventh Aspect

The sheet processing apparatus according to any one of the second to sixth aspects, the liquid applier includes a liquid amount adjuster to adjust an amount of liquid in the liquid application. The liquid amount adjuster reduces the amount of liquid when the liquid applier presses the downstream end.

Eighth Aspect

In the sheet processing apparatus according to any one of the second to seventh aspects, the liquid applier includes: a liquid application head to execute the liquid application; and a pressing part to execute pressing. During execution of the pressing on the downstream end, the pressing part presses the downstream end and the liquid application head does not contact the downstream end.

Ninth Aspect

In the sheet processing apparatus according to the eighth aspect, when the pressing and the crimp binding are executed on a same position, the pressing part and the liquid application head presses the downstream end.

Tenth Aspect

The sheet processing apparatus according to any one of the second to ninth aspects further includes a liquid application mover to move the liquid applier in a main scanning direction. The liquid applier presses the downstream end at substantially a center of the downstream end in the main scanning direction.

Eleventh Aspect

The sheet processing apparatus according to the tenth aspect further includes a crimping unit mover to move the crimp binder in the main scanning direction. The liquid applier and the crimp binder press the downstream end at different positions in the main scanning direction.

Twelfth Aspect

An image forming apparatus includes a housing; an image former housed in the housing to form an image on a sheet medium; and the sheet processing apparatus according to any one of the first to eleventh aspects to execute crimp binding of the sheet medium on which the image has been formed by the image former. The sheet processing apparatus is detachably supported by the housing.

Thirteenth Aspect

An image forming system includes: an image forming apparatus to form an image on a sheet medium; and the sheet processing apparatus according to any one of the first to eleventh aspects coupled to the image forming apparatus.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention. Any one of the above-described operations may be performed in various other ways, for example, in an order different from the one described above.

The functionality of the elements disclosed herein may be implemented using circuitry or processing circuitry which includes general purpose processors, special purpose processors, integrated circuits, application specific integrated circuits (ASICs), digital signal processors (DSPs), field programmable gate arrays (FPGAs), conventional circuitry and/or combinations thereof which are configured or programmed to perform the disclosed functionality. Processors are considered processing circuitry or circuitry as they include transistors and other circuitry therein. In the disclosure, the circuitry, units, or means are hardware that carry out or are programmed to perform the recited functionality. The hardware may be any hardware disclosed herein or otherwise known which is programmed or configured to carry out the recited functionality. When the hardware is a processor which may be considered a type of circuitry, the circuitry, means, or units are a combination of hardware and software, the software being used to configure the hardware and/or processor.

The invention claimed is:

1. A sheet processing apparatus comprising:

an ejection tray to stack a plurality of sheet media;

an internal tray to stack the sheet media at a position different from the ejection tray;

a first conveyor to convey a sheet medium in a first direction in which the sheet medium is ejected to the ejection tray;

a second conveyor to come into contact with and separate from the sheet media stacked on the internal tray to convey the sheet media in a second direction different from the first direction;

a crimp binder disposed downstream from the internal tray in the second direction to execute crimp binding on the sheet media stacked on the internal tray; and control circuitry configured to control operations of the first conveyor, the second conveyor, and the crimp binder, wherein when a subsequent sheet medium, which is subsequent to a preceding sheet medium of the sheet media stacked on the internal tray, is conveyed in the first direction while contacting the preceding sheet medium, the control circuitry causes the crimp binder to press a downstream end of the preceding sheet medium in the second direction.

2. An image forming apparatus comprising:

a housing;

an image former housed in the housing to form an image on a sheet medium; and the sheet processing apparatus according to claim 1 to execute crimp binding of the sheet medium on which the image has been formed by the image former, wherein the sheet processing apparatus is detachably supported by the housing.

3. An image forming system comprising:

an image forming apparatus to form an image on a sheet medium; and the sheet processing apparatus according to claim 1 coupled to the image forming apparatus.

4. A sheet processing apparatus comprising:

an ejection tray to stack a plurality of sheet media;

an internal tray to stack the sheet media in a different position from the ejection tray;

a first conveyor to convey a sheet medium in a first direction in which the sheet medium is ejected to the ejection tray;

a second conveyor to come into contact with and separate from the sheet media stacked on the internal tray to convey the sheet media in a second direction different from the first direction;

a liquid applier disposed downstream from the internal tray in the second direction to perform liquid application to the sheet media stacked on the internal tray;

a crimp binder disposed downstream from the internal tray in the second direction to execute crimp binding on the sheet media stacked on the internal tray; and control circuitry configured to control operations of the first conveyor, the second conveyor, the liquid applier, and the crimp binder, wherein when a subsequent sheet medium, which is subsequent to a preceding sheet medium of the sheet media stacked on the internal tray, is conveyed in the first direction while contacting the preceding sheet medium, the control circuitry causes the liquid applier or the crimp binder to press a downstream end of the preceding sheet medium in the second direction.

5. The sheet processing apparatus according to claim 4, wherein the control circuitry causes the crimp binder and the liquid applier to press the downstream end of the preceding sheet medium in the second direction.

6. The sheet processing apparatus according to claim 4, wherein, when the subsequent sheet medium is being conveyed in the second direction, the control circuitry causes the liquid applier or the crimp binder to release pressing on the downstream end.

7. The sheet processing apparatus according to claim 4, further comprising:

a media detector to detect a position of a sheet medium being conveyed; and a reference fence on which an end of the subsequent sheet medium abuts when the subsequent sheet medium is stacked on the preceding sheet medium, wherein, when the subsequent sheet medium is conveyed in the second direction, the control circuitry causes the liquid applier or the crimp binder to release pressing on the downstream end.

8. The sheet processing apparatus according to claim 4, further comprising:

a media shifter to move a position of a sheet medium in a main scanning direction, wherein, when the media shifter moves the position of the sheet medium in the main scanning direction without execution of the crimp binding, the control circuitry causes the liquid applier or the crimp binder to press the downstream end.

9. The sheet processing apparatus according to claim 4, wherein the liquid applier includes a liquid amount adjuster to adjust an amount of liquid in the liquid application, and wherein the liquid amount adjuster reduces the amount of liquid when the liquid applier presses the downstream end.

10. The sheet processing apparatus according to claim 4, wherein the liquid applier includes:

a liquid application head to execute the liquid application; and a pressing part to execute pressing, and wherein, during execution of the pressing on the downstream end, the pressing part presses the downstream end and the liquid application head does not contact the downstream end.

11. The sheet processing apparatus according to claim 10, wherein, when the pressing and the crimp binding are executed on a same position, the pressing part and the liquid application head presses the downstream end.

12. The sheet processing apparatus according to claim 4, further comprising:

a liquid application mover to move the liquid applier in a main scanning direction, wherein the liquid applier presses the downstream end at substantially a center of the downstream end in the main scanning direction.

13. The sheet processing apparatus according to claim 12, further comprising:

a crimping unit mover to move the crimp binder in the main scanning direction, wherein the liquid applier and the crimp binder press the downstream end at different positions in the main scanning direction.

* * * * *